US010267015B2

(12) United States Patent
Landry et al.

(10) Patent No.: US 10,267,015 B2
(45) Date of Patent: Apr. 23, 2019

(54) SURFACE-FORMING EQUIPMENT AND MOTORIZED SURFACE-FORMING EQUIPMENT

(71) Applicants: Jocelyn Landry, Ste-Geneviève de Berthier (CA); Martin Coulombe, St-Ignace-de-Loyola (CA)

(72) Inventors: Jocelyn Landry, Ste-Geneviève de Berthier (CA); Martin Coulombe, St-Ignace-de-Loyola (CA)

(73) Assignee: 9277-9347 QUEBEC INC., Ste-Genevieve de Berthier, Quebec (CA)

( * ) Notice: Subject to any disclaimer, the term of this patent is extended or adjusted under 35 U.S.C. 154(b) by 61 days.

(21) Appl. No.: 15/025,103

(22) PCT Filed: Sep. 26, 2014

(86) PCT No.: PCT/CA2014/050926
§ 371 (c)(1),
(2) Date: Mar. 25, 2016

(87) PCT Pub. No.: WO2015/042716
PCT Pub. Date: Apr. 2, 2015

(65) Prior Publication Data

US 2016/0251825 A1 Sep. 1, 2016

(30) Foreign Application Priority Data

Sep. 26, 2013 (CA) ..... 2828386
Feb. 24, 2014 (CA) ..... 2843467

(51) Int. Cl.
*E01C 19/18* (2006.01)
*E02F 3/76* (2006.01)
*E02F 3/815* (2006.01)

(52) U.S. Cl.
CPC ..... *E02F 3/7627* (2013.01); *E01C 19/187* (2013.01); *E02F 3/7622* (2013.01); *E02F 3/8152* (2013.01); *E02F 3/8155* (2013.01)

(58) Field of Classification Search
CPC .... E01C 19/12; E01C 19/187; E01C 19/4866; E01C 19/4873; E02F 3/76; E02F 3/815
(Continued)

(56) References Cited

U.S. PATENT DOCUMENTS 1,227,308 A * 5/1917 Plank ..... E04F 21/06 15/235.5
1,496,621 A 6/1924 Burrell
(Continued)

FOREIGN PATENT DOCUMENTS

AU 2009202478 A1 1/2010
DE 3608893 A1 9/1987
(Continued)

OTHER PUBLICATIONS

European Search Report for corresponding European Patent Application No. 14848811.7 dated Apr. 25, 2017, 8 pages.
(Continued)

*Primary Examiner* — Gary S Hartmann
(74) *Attorney, Agent, or Firm* — Merchant & Gould P.C.

(57) ABSTRACT

Surface-formation equipment includes a blade including a beam; and an attachment structure having a proximal end connected to the blade and a distal end configured to be attached to a mobile unit. The surface-formation equipment may also include a blade including a beam; and at least one lateral wing pivot-connected to one end of the main section, the at least one lateral wing being able to be configured in an unfolded configuration and at least one folded position. The surface-formation equipment may include a cutting edge secured to the beam near the lower surface.

26 Claims, 13 Drawing Sheets

(58) Field of Classification Search
USPC ..... 404/118
See application file for complete search history.

(56) References Cited

U.S. PATENT DOCUMENTS

| | | | | | |
|---|---|---|---|---|---|
| 1,543,222 | A | | 6/1925 | McVeety | |
| 2,192,254 | A | * | 3/1940 | Beadle | E02F 3/764 172/783 |
| 3,378,084 | A | * | 4/1968 | Ulrich | E02F 3/7613 172/247 |
| 3,780,813 | A | * | 12/1973 | Davis | E02F 3/76 172/438 |
| 3,901,618 | A | | 8/1975 | Sant'agata | |
| 4,702,641 | A | * | 10/1987 | Naser | E01C 19/44 15/235.8 |
| 5,010,961 | A | * | 4/1991 | Frisbee | E02F 3/7613 172/821 |
| 5,343,959 | A | * | 9/1994 | Frisbee | E02F 3/8152 172/701.3 |
| 5,609,437 | A | * | 3/1997 | Silva | E01C 19/44 15/235.4 |
| 5,676,489 | A | * | 10/1997 | Willhoite | E01C 19/187 404/101 |
| 5,718,295 | A | * | 2/1998 | Trahan | E02F 3/7622 172/26.5 |
| 5,720,353 | A | | 2/1998 | Wilkening | |
| 5,890,546 | A | | 4/1999 | Kerpash | |
| 6,442,877 | B1 | | 9/2002 | Quenzi et al. | |
| 7,320,558 | B2 | * | 1/2008 | Quenzi | E01C 19/006 404/114 |
| 7,470,084 | B2 | * | 12/2008 | Brotzel | E01C 19/44 404/118 |
| 7,909,533 | B2 | * | 3/2011 | Quenzi | E01C 19/006 404/114 |
| 8,292,000 | B2 | * | 10/2012 | Takami | E02F 3/7627 172/813 |
| 8,678,103 | B2 | * | 3/2014 | Miyuki | E02F 3/7631 172/813 |
| 9,260,836 | B2 | * | 2/2016 | Nakata | E02F 3/769 |
| 2011/0011604 | A1 | | 1/2011 | Takami et al. | |
| 2013/0000929 | A1 | | 1/2013 | Anderson | |

FOREIGN PATENT DOCUMENTS

| | | |
|---|---|---|
| EP | 1 533 426 A1 | 5/2005 |
| JP | S53-046712 | 4/1978 |

OTHER PUBLICATIONS

Japanese Office Action for corresponding Japanese Patent Application No. 2016-544690 dated Jul. 10, 2018, 5 pages.

* cited by examiner

SURFACE-FORMING EQUIPMENT AND MOTORIZED SURFACE-FORMING EQUIPMENT

This application is a National Stage Application of PCT/CA2014/050926, filed 26 Sep. 2014, which claims benefit of Serial No. 2,828,386, filed 26 Sep. 2013 in Canada and Serial No. 2,843,467, filed 24 Feb. 2014 in Canada, and which applications are incorporated herein by reference. To the extent appropriate, a claim of priority is made to each of the above disclosed applications.

FIELD OF THE INVENTION

The present invention relates to equipment designed for forming (shaping) surfaces. It also relates to a method of manufacture of equipment designed for forming surfaces, to the use thereof and to the assembly of said equipment with mobile units.

BACKGROUND

Equipment (apparatus or devices) for the formation of surfaces, such as ground covering consisting of granular or liquid materials (e.g.: liquid concrete) currently in use in industry and available on the market takes numerous and varied forms. Some equipment has been designed for an application specifically intended for the formation of surfaces, such as leveling. Other equipment commonly used for forming surfaces has not been designed for this application but is nonetheless used for this purpose.

Surface formation includes activities in which granular materials, such as earth, sand, gravel, fine rock, stone dust, mulch, crushed stone, recycled asphalt, liquid concrete and other granular or liquid substrates, such as concrete, laying on the ground, are moved to create a desired surface profile. Surface formation includes the leveling of the ground during which the ground is flattened. Surface formation may also include the movement of the granular material in order to create a slope, an embankment, etc. Surface formation is frequently carried out in the activities of landscaping, public work, agricultural work and industrial work.

Numerous manufacturers of "dozer blades" supply the market with surface formation equipment. Among these, the Caterpillar, Kubota, John Deere, Yanmar, Bobcat and other companies supply the market with substantially straight and flat blades that can be mounted at the front or at the rear of a motorized unit (or motorized vehicle), as described in American patent application No. 2013/0000929 published on Jan. 3, 2013, and in German document No. DE3608893 published on Sep. 24, 1987. However, these blades are designed chiefly for pushing granular material rather than for leveling ground. In certain situations they may have a tendency to tilt forward and thus dig into the ground. There are also leveling platforms or other leveling units that are mounted at the rear of a motorized unit, like the one described in U.S. Pat. No. 3,901,618, published on Aug. 26, 1975. However, it is impossible to use these for pushing granular material effectively.

There are also items of apparatus designed specifically for leveling a surface or for moving granular material. However, these are generally less multifunctional and/or have relatively slow speeds of travel.

The surface-formation equipment desired needs to be able to be fitted to mobile units and needs to have at least one of the following properties:

1. Compactness;
2. High efficiency, notably efficiency that remains constant even when used at a relatively high speed of travel;
3. Good handling;
4. Great multifunctionality for the broad range of landscaping work;
5. A small footprint in operation and/or when laid up and/or for transport;
6. A limited number of component parts;
7. A long life without premature wear despite the generally harsh conditions of use (including harsh weather conditions, intense abrasion, impacts, etc.);
8. Ease of assembly of the component parts of the equipment; and
9. A competitive cost price.

In view of the above statements, there is therefore a need for surface-formation equipment capable of overcoming or at least minimizing at least one disadvantage of the prior art.

SUMMARY OF THE INVENTION

Therefore one object of the present invention is to provide surface-formation equipment that can be fitted to mobile units, such as those of the caterpillar type (notably of the compact loader type with differential (skidsteer) steering operating in the field of civil engineering, agricultural and/or industrial work, the equipment being without at least one of the disadvantages of the equipment of the prior art. The mobile units include motorized units such as those intended for leveling operations.

In general, the invention relates to surface-formation equipment, comprising: a blade including a beam with a closed profile having the shape of a geometric profile that is elongate along a longitudinal axis, having at least three surfaces extending along the longitudinal axis and defining an interior volume between these surfaces; and an attachment structure having a proximal end connected to the blade and a distal end configured to be attached to a mobile unit.

In one embodiment, the beam comprises a lower surface and the blade comprises a cutting edge secured to the beam near the lower surface, the cutting edge being in contact with a surface that is to be formed while the surface-formation equipment is being used. The beam may comprise a front surface and a rear surface and the cutting edge protrudes beyond the lower surface of the beam at the front surface and at the rear surface. The cutting edge may protrude beyond the lower surface of the beam at the lateral ends of the beam. In one embodiment, the cutting edge protrudes beyond the lower surface of the beam by at least ½ an inch. The cutting edge may fully cover the lower surface of the beam. In one embodiment, the cutting edge has a surface area greater than the surface area of the lower surface of the beam. The cutting edge may have an edge that is chamfered along the longitudinal axis. The chamfered edge may form an acute angle, the point of which projects toward the outside of the beam. In one embodiment, the cutting edge has a thickness of between ⅜ of an inch and 1 inch. The cutting edge may have a substantially planar lower surface. The cutting edge may be made of a material with high resistance to abrasion. In one embodiment, the cutting edge has a thickness less than the height of the beam. The cutting edge may comprise a lower surface in contact with the ground and an upper surface in contact with the lower surface of the beam, the lower surface area being greater than the surface area of the upper surface.

In one embodiment, the attachment structure is configured to attach the blade to the front of the mobile unit.

In one embodiment, the attachment structure comprises two arms which are engaged with one another at their proximal end and spaced apart at their distal end.

In one embodiment, the surface-formation equipment comprises a blade-pivoting assembly connected to the blade and to the attachment structure and allowing the blade to be pivoted between a straight position in which a longitudinal axis of the blade is oriented substantially perpendicular to a direction of travel of the equipment and a plurality of inclined positions in which the longitudinal axis of the blade defines an oblique angle with the direction of travel of the equipment. The blade-pivoting assembly may pivot about an axis of pivoting of the blade, substantially aligned with the center of the blade along the longitudinal axis thereof and substantially perpendicular thereto, spaced away to the rear of this blade and substantially vertical. The pivoting assembly may comprise a turntable system including a first disk, mounted fixedly on the blade and extending to the rear thereof, a support surface at the proximal end of the attachment structure, and at least one securing piece secured to the support surface with the first disk extending between the two and preventing the disengagement of the first disk, the central disk being able to pivot between the support surface and the at least one securing piece about the axis of pivoting of the blade, aligned with the center of the turntable system. The support surface may comprise an upper plate fixedly mounted on the proximal end of the attachment structure. The at least one securing piece may comprise two hoops secured to the support surface. The pivoting assembly may comprise at least one actuator. For example, the pivoting assembly may comprise at least two actuators with at least one of the two actuators arranged on each side of the axis of pivoting of the blade. Each of the two actuators may comprise an actuating cylinder having a first end secured to the attachment structure and a second end secured to the blade. The actuating cylinder may comprise a single-acting actuating cylinder.

In one embodiment, the interior volume defined inside the beam is substantially empty. The beam may comprise an internal reinforcing structure including at least one reinforcing member extending in the interior volume between two of the at least three surfaces. In one embodiment, the beam has a length of at least seven times greater than its height, and the depth of which is less than its height. In one embodiment, the beam has a width varying between 2 inches and 12 inches. In one embodiment, the beam has at least six surfaces. The beam may comprise at least two lateral surfaces. In one embodiment, the beam comprises a front surface and a rear surface and of the front and rear surfaces at least one is concave. In one embodiment, the beam comprises a planar lower surface and a planar upper surface, extending along the longitudinal axis parallel to one another. In one embodiment, the blade comprises a main section and at least one lateral wing pivot-connected to one end of the main section. The at least one lateral wing may comprise two lateral wings, each one being pivot-connected to a respective end of the main section. The at least one lateral wing may have a length less than half the length of the main section along the longitudinal axis. The at least one lateral wing may comprise a wing-pivoting assembly mounted at one end of the main section, in an upper part of the beam. The wing-pivoting assembly may comprise at least one actuator having a first end mounted to the main section and a second end mounted to the at least one lateral wing. The at least one actuator may comprise an actuating cylinder, such as a double-acting actuating cylinder.

In one embodiment, the wing-pivoting assembly comprises: a cylinder cavity defined in one out of the main section and the at least one lateral wing, in the respective adjacent end; at least two plates, spaced apart, extending at the respective adjacent end of the other out of the main section and the at least one lateral wing; and a core inserted into the cylindrical cavity and secured to at least two plates, the plates covering the openings of the cylindrical cavity and the at least one core being able to rotate inside the cylindrical cavity, an axis of pivoting of the wing extending at right angles to the longitudinal axis of the blade, in the center of the core. In one embodiment, the axis of pivoting of the wing is situated in the upper part of the beam and below the upper surface of the beam.

In one embodiment, the at least one lateral wing pivots about an axis of pivoting of the wing extending at right angles to the longitudinal axis of the blade.

In one embodiment, when the at least one lateral wing is in the unfolded configuration, the lower surface of the at least one lateral wing is in the same plane as the lower surface of the main section so as to form a continuous surface for contact with the ground.

In one embodiment, each of the at least one wing and the main section comprises a lower surface with a cutting edge secured to the beam near the respective lower surface, the cutting edge being in contact with a surface that is to be formed when the surface-formation equipment is in use, the cutting edge of the main section comprising at least one out of a male connector and a female connector at its lateral end and the cutting edge of the at least one wing comprising at least one of the other out of the male connector and the female connector at its end adjacent to the main section, it being possible for the male and female connectors to engage one inside the other when the blade is in the unfolded configuration.

In one embodiment, the surface-formation equipment comprises a deflector mounted to the main section and extending substantially vertically above the upper surface of the beam.

In one embodiment, the adjacent ends of the at least one wing and of the main section are inclined and of substantially complementing shapes.

Another general aspect of the invention relates to surface-formation equipment comprising: a blade including a beam having the form of a geometric profile that is elongate along a longitudinal axis, the blade including a main section and at least one lateral wing pivot-connected to one end of the main section, the at least one lateral wing being able to be configured in an unfolded configuration and at least one folded position.

In one embodiment, the at least one lateral wing comprises two lateral wings, each one being pivot-connected to a respective end of the main section.

In one embodiment, the at least one lateral wing has a length less than half the length of the main section along the longitudinal axis.

In one embodiment, the at least one lateral wing comprises a wing-pivoting assembly mounted at one end of the main section, in an upper part of the beam. The wing-pivoting assembly may comprise at least one actuator, such as an actuating cylinder, having a first end mounted to the main section and a second end mounted to the at least one lateral wing.

In one embodiment, the wing-pivoting assembly comprises: a cylinder cavity defined in one out of the main section and the at least one lateral wing, in the respective adjacent end; at least two plates, spaced apart, extending at the respective adjacent end of the other out of the main section and of the at least one lateral wing; and a core inserted into the cylindrical cavity and secured to at least two plates, the plates covering the openings of the cylindrical cavity and the at least one core being able to rotate inside the cylindrical cavity, an axis of pivoting of the wing extending at right angles to the longitudinal axis of the blade, in the center of the core. The axis of pivoting of the wing may be situated in the upper part of the beam and below the upper surface of the beam.

In one embodiment, the at least one lateral wing pivots about an axis of pivoting of the wing extending at right angles to the longitudinal axis.

In one embodiment, when the at least one lateral wing is in the unfolded configuration, the lower surface of the at least one lateral wing is in the same plane as the lower surface of the main section so as to form a continuous surface for contact with the ground.

In one embodiment, each of the at least one lateral wing and the main section comprises a lower surface with a cutting edge secured to the beam near the respective lower surface, the cutting edge being in contact with a surface that is to be formed when the surface-formation equipment is in use, the cutting edge of the main section comprising at least one out of a male connector and a female connector at its lateral end and the cutting edge of the at least one lateral wing comprising at least one of the other out of the male connector and the female connector at its end adjacent to the main section, it being possible for the male and female connectors to engage one inside the other when the blade is in the unfolded configuration.

In one embodiment, the surface-formation equipment comprises a deflector mounted to the main section and extending substantially vertically above the upper surface of the beam.

In one embodiment, the adjacent ends of the at least one wing and of the main section are inclined and of substantially complementing shapes.

In one embodiment, the surface-formation equipment comprises an attachment structure having a proximal end connected to the blade and a distal end configured to be attached to a mobile unit. The attachment structure may be configured to attach the blade to the front of the mobile unit. The attachment structure may comprise two arms which are engaged with one another at their proximal end and spaced apart at their distal end.

In one embodiment, the surface-formation equipment comprises a blade-pivoting assembly connected to the blade and to the attachment structure and allowing the blade to be pivoted between a straight position in which a longitudinal axis of the blade is oriented substantially perpendicular to a direction of travel of the equipment and a plurality of inclined positions in which the longitudinal axis of the blade defines an oblique angle with the direction of travel of the equipment. The blade-pivoting assembly may pivot about an axis of pivoting of the blade, substantially aligned with the center of the blade along the longitudinal axis thereof and substantially perpendicular thereto, spaced away to the rear of this blade and substantially vertical. The pivoting assembly may comprise a turntable system including a first disk, mounted fixedly on the blade and extending to the rear thereof, a support surface at the proximal end of the attachment structure, and at least one securing piece secured to the support surface with the first disk extending between the two and preventing the disengagement of the first disk, the central disk being able to pivot between the support surface and the at least one securing piece about the axis of pivoting of the blade, aligned with the center of the turntable system. The support surface may comprise an upper plate fixedly mounted on the proximal end of the attachment structure. The at least one securing piece may comprise two hoops secured to the support surface. The pivoting assembly may comprise at least one actuator. For example, the pivoting assembly may comprise at least two actuators with at least one of the two actuators arranged on each side of the axis of pivoting of the blade. Each of the two actuators may comprise an actuating cylinder, such as a single-acting actuating cylinder, having a first end secured to the attachment structure and a second end secured to the blade.

In one embodiment, the beam comprises a lower surface and the blade comprises a cutting edge secured to the beam near the lower surface, the cutting edge being in contact with a surface that is to be formed while the surface-formation equipment is being used. The beam may comprise a front surface and a rear surface and the cutting edge protrudes beyond the lower surface of the beam at the front surface and at the rear surface. The cutting edge may protrude beyond the lower surface of the beam at the lateral ends of the beam. The cutting edge may protrude beyond the lower surface of the beam by at least ½ an inch. The cutting edge may fully cover the lower surface of the beam. In one embodiment, the cutting edge has a surface area greater than the surface area of the lower surface of the beam. In one embodiment, the cutting edge has an edge that is chamfered along the longitudinal axis. For example, the chamfered edge may form an acute angle, the point of which projects toward the outside of the beam. In one embodiment, the cutting edge has a thickness of between ⅜ of an inch and 1 inch. The cutting edge may have a substantially planar lower surface. The cutting edge may be made of a material with high resistance to abrasion. The cutting edge may have a thickness less than the height of the beam. The cutting edge may comprise a lower surface in contact with the ground and an upper surface in contact with the lower surface of the beam, the lower surface area being greater than the surface area of the upper surface.

In one embodiment, the beam has a length of at least seven times greater than its height, and the depth of which is less than its height.

In one embodiment, the beam is a beam with a closed profile having the form of a geometric profile that is elongate along a longitudinal axis, having at least three surfaces extending along the longitudinal axis and defining an interior volume between these surfaces. The interior volume defined inside the beam may be substantially empty. The beam may comprise an internal reinforcing structure including at least one reinforcing member extending in the interior volume between two of the at least three surfaces. In one embodiment, the beam has a width varying between 2 and 12 inches.

In one embodiment, the beam has at least six surfaces. The beam may comprise at least two lateral surfaces.

In one embodiment, the beam comprises a front surface and a rear surface and of the front and rear surfaces at least one is concave.

In one embodiment, the beam comprises a planar lower surface and a planar upper surface, extending along the longitudinal axis parallel to one another.

Another general aspect of the invention relates to surface-formation equipment comprising a blade including a beam with a closed profile having the form of a geometric profile that is elongate along a longitudinal axis, having at least three surfaces extending along the longitudinal axis and defining an interior volume between these surfaces; and a cutting edge secured to the beam near the lower surface, the cutting edge being in contact with a surface that is to be formed while the surface-formation equipment is being used.

In one embodiment, the beam comprises a front surface and a rear surface and the cutting edge protrudes beyond the lower surface of the beam at the front surface and at the rear surface. The cutting edge may protrude beyond the lower surface of the beam at the lateral ends of the beam. The cutting edge may protrude beyond the lower surface of the beam by at least ½ an inch. The cutting edge may fully cover the lower surface of the beam. The cutting edge may have a surface area greater than the surface area of the lower surface of the beam. The cutting edge may have an edge that is chamfered along the longitudinal axis. The chamfered edge may form an acute angle, the point of which projects toward the outside of the beam. The cutting edge may have a thickness of between ⅜ of an inch and 1 inch. The cutting edge may have a substantially planar lower surface. The cutting edge may be made of a material with high resistance to abrasion. The cutting edge may have a thickness less than the height of the beam. The cutting edge may comprise a lower surface in contact with the ground and an upper surface in contact with the lower surface of the beam, the lower surface area being greater than the surface area of the upper surface.

In one embodiment, the surface-formation equipment comprises: an attachment structure having a proximal end connected to the blade and a distal end configured to be attached to a mobile unit; and a blade-pivoting assembly connected to the blade and to the attachment structure and allowing the blade to be pivoted between a straight position in which a longitudinal axis of the blade is oriented substantially perpendicular to a direction of travel of the equipment and a plurality of inclined positions in which the longitudinal axis of the blade defines an oblique angle with the direction of travel of the equipment.

In one embodiment, the blade-pivoting assembly pivots about an axis of pivoting of the blade, substantially aligned with the center of the blade along the longitudinal axis thereof and substantially perpendicular thereto, spaced away to the rear of this blade and substantially vertical.

In one embodiment, the pivoting assembly comprises a turntable system including a first disk, mounted fixedly on the blade and extending to the rear thereof, a support surface at the proximal end of the attachment structure, and at least one securing piece secured to the support surface with the first disk extending between the two and preventing the disengagement of the first disk, the central disk being able to pivot between the support surface and the at least one securing piece about the axis of pivoting of the blade, aligned with the center of the turntable system. The support surface may comprise an upper plate fixedly mounted on the proximal end of the attachment structure. The at least one securing piece may comprise two hoops secured to the support surface. The pivoting assembly may comprise at least one actuator. For example, the pivoting assembly may comprise at least two actuators with at least one of the two actuators arranged on each side of the axis of pivoting of the blade. Each of the two actuators may comprise an actuating cylinder, such as a single-acting actuating cylinder, having a first end secured to the attachment structure and a second end secured to the blade.

In one embodiment, the interior volume defined inside the beam is substantially empty. The beam may comprise an internal reinforcing structure including at least one reinforcing member extending in the interior volume between two of the at least three surfaces. The beam may have a length of at least seven times greater than its height, and the depth of which is less than its height. In one embodiment, the beam has a width varying between 2 and 12 inches. In one embodiment, the beam has at least six surfaces. The beam may comprise at least two lateral surfaces. The beam may comprise a front surface and a rear surface and of the front and rear surfaces at least one is concave. The beam may comprise a planar lower surface and a planar upper surface, extending along the longitudinal axis parallel to one another.

Another general aspect of the invention relates to surface-formation equipment comprising: a blade including a beam having the form of a geometric profile that is elongate along a longitudinal axis, the blade including a main section; an attachment structure having a proximal end connected to the blade and a distal end configured to be attached to a mobile unit; and a blade-pivoting assembly connected to the blade and to the attachment structure and allowing the blade to be pivoted between a straight position in which a longitudinal axis of the blade is oriented substantially perpendicular to a direction of travel of the equipment and a plurality of inclined positions in which the longitudinal axis of the blade defines an oblique angle with the direction of travel of the equipment.

In one embodiment, the blade-pivoting assembly pivots about an axis of pivoting of the blade, substantially aligned with the center of the blade along the longitudinal axis thereof and substantially perpendicular thereto, spaced away to the rear of this blade and substantially vertical.

In one embodiment, the pivoting assembly comprises a turntable system including a first disk, mounted fixedly on the blade and extending to the rear thereof, a support surface at the proximal end of the attachment structure, and at least one securing piece secured to the support surface with the first disk extending between the two and preventing the disengagement of the first disk, the central disk being able to pivot between the support surface and the at least one securing piece about the axis of pivoting of the blade, aligned with the center of the turntable system. The support surface may comprise an upper plate fixedly mounted on the proximal end of the attachment structure.

In one embodiment, the at least one securing piece may comprise two hoops secured to the support surface.

In one embodiment, the pivoting assembly comprises at least two actuators with at least one of the two actuators arranged on each side of the axis of pivoting of the blade. Each of the at least two actuators may comprise an actuating cylinder, such as a single-acting actuating cylinder, having a first end secured to the attachment structure and a second end secured to the blade.

In one embodiment, the beam has a length of at least seven times greater than its height, and the depth of which is less than its height. The beam may have a width varying between 2 and 12 inches.

The beam may comprise a planar lower surface and a planar upper surface, extending along the longitudinal axis parallel to one another.

In one embodiment, the surface-formation equipment comprises a cutting edge secured to the beam near the lower surface, the cutting edge being in contact with a surface that is to be formed while the surface-formation equipment is being used. The cutting edge may protrude beyond the lower surface of the beam. The cutting edge may protrude beyond the lower surface of the beam at the lateral ends of the beam. The cutting edge may protrude beyond the lower surface of the beam by at least ½ an inch. In one embodiment, the cutting edge fully covers the lower surface of the beam. In one embodiment, the cutting edge has a surface area greater than the surface area of the lower surface of the beam. The cutting edge may have an edge that is chamfered along the longitudinal axis. The chamfered edge may form an acute angle, the point of which projects toward the outside of the beam. The cutting edge may have a thickness of between ⅜ of an inch and 1 inch. The cutting edge may have a substantially planar lower surface. The cutting edge may be made of a material with high resistance to abrasion. The cutting edge may have a thickness less than the height of the beam. The cutting edge may comprise a lower surface in contact with the ground and an upper surface in contact with the lower surface of the beam, the lower surface area being greater than the surface area of the upper surface.

Another general aspect of the invention relates to motorized surface-formation equipment comprising: a motorized unit; and surface-formation equipment as described hereinabove, mounted to the motorized unit. The surface-formation equipment may be mounted removably at the front of the motorized unit. In one embodiment, the motorized unit comprises a surface for contact with the ground and the lower surface of the blade of the surface-formation equipment is mounted in the same plane as the surface for contact with the ground of the motorized unit. In one embodiment, the motorized unit comprises a support to accept the surface-formation equipment, and the support is mounted so that it can be pivoted and controlled so as to modify the position of the blade.

Another general aspect of the invention relates to a method of manufacturing surface-formation equipment as described hereinabove.

Another general aspect of the invention relates to the use of surface-formation equipment as described hereinabove.

Another general aspect of the invention relates to a pivoting mechanism for the mutual pivoting of two components and comprising: a central disk fixedly mounted to a first component; a support surface on the second component; and at least one securing piece secured to the support surface with the central disk extending between the two and preventing the disengagement of the central disk, the central disk being able to pivot between the support surface and the at least one securing piece.

In one embodiment, the central disk is of circular shape and has a T-shaped profile. In one embodiment, the support surface comprises an upper plate. In one embodiment, the at least one securing piece comprises two hoops arranged under the support disk. In one embodiment, the mechanism comprises at least one actuator connected to the first component and to the second component so as to allow the pivoting of the central disk relative to the support surface.

In the specification, the term "beam" is used to denote an object, a body or a structure having an elongate geometric profile extending along a longitudinal axis. The beam may have the profile of the common structural elements including I-section beams, C-section beams, L-section beams, T-section beams, beams in the form of tubes the surfaces of which are planar or curved, etc.

In the specification, the term "beam with a closed profile" is used to denote an object, a body or a structure having an elongate geometric profile extending along a longitudinal axis, having at least three surfaces extending along the longitudinal axis and defining an interior volume between the surfaces. The profile of the beam with a closed profile, in a plane of section perpendicular to its longitudinal axis, defines a closed figure. The beam with a closed profile has three dimensions (length, depth (or width) and height) and its geometric profile is elongate because its length is substantially greater, or greater, or markedly greater, than its depth and its height. The interior volume defined by the at least three surfaces may be filled, part-empty, substantially empty, or completely empty (hollow). In one embodiment, the beam with a closed profile has at least five surfaces including the at least three surfaces extending along the longitudinal axis of the beam and two lateral surfaces closing off the ends. The ends of the beam with a closed profile may be open or may be closed by a surface. In one embodiment, the elongate geometric profile has six faces (which means to say six surfaces) which may be of planar, concave or convex shape. In one embodiment, the beam with a closed profile has a cross-sectional profile, along an axis of section perpendicular to its longitudinal axis, of substantially rectangular, square, rhomboid, trapezoidal, etc. shape. In one embodiment, the cross-sectional profile of the beam with a closed profile is substantially trapezoidal, but with some of the surfaces having a substantially concave shape, most particularly the surfaces meeting at the corners running parallel to the longitudinal axis.

In embodiments in which the beam is not a beam with a closed profile, this beam has at least one lower flange and a web extending from the lower flange. In one embodiment, the beam also has an upper flange and the web extends between the lower flange and the upper flange. The web may have a flat or curved profile.

In the specification, the term "wing" is used to denote a lateral section mounted laterally with respect to a main section of the blade in the case of blades made in two or more sections.

In the specification, the term "leveling" is used to denote a surface-formation activity and, more particularly, the flattening of a surface, whether it is level or inclined.

In the specification, the term "proximal" is used to denote an element or component close to the blade or to the center of the blade, whereas the term "distal" is used to denote an element or a component that is distant from the blade or from the center of the blade (close to the ends thereof).

DETAILED DESCRIPTION

Figure 1:
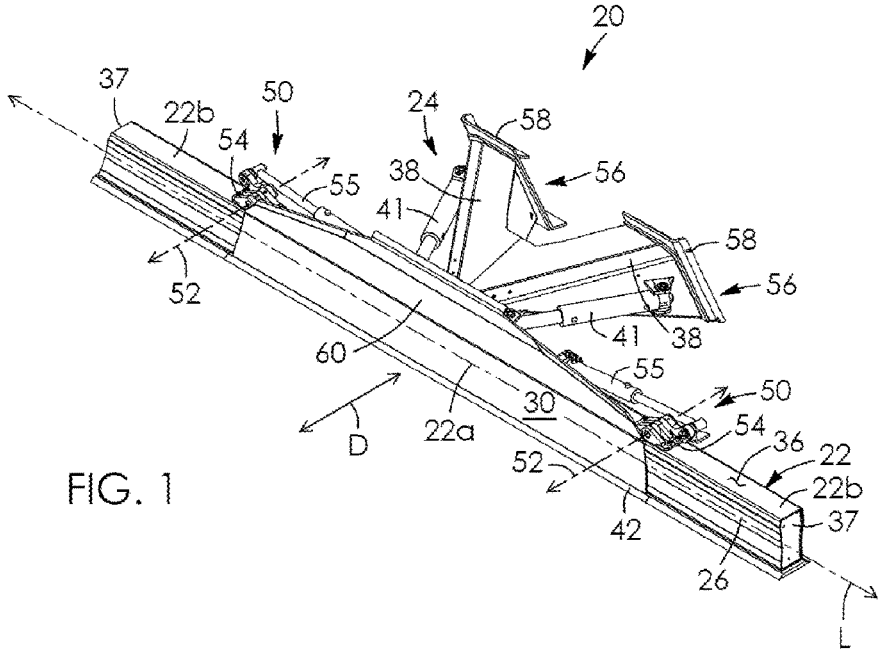
FIG. 1 is a perspective view from front right of surface formation equipment according to one embodiment, including two lateral wings which are configured in the unfolded (or elongate) position.
Figure 2:
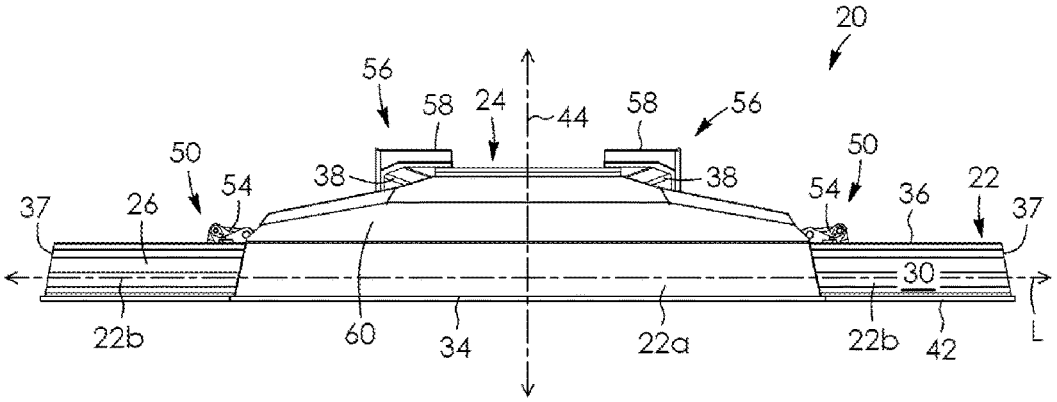
FIG. 2 is a view in front elevation of the surface-formation equipment illustrated in FIG. 1.
Figure 3:
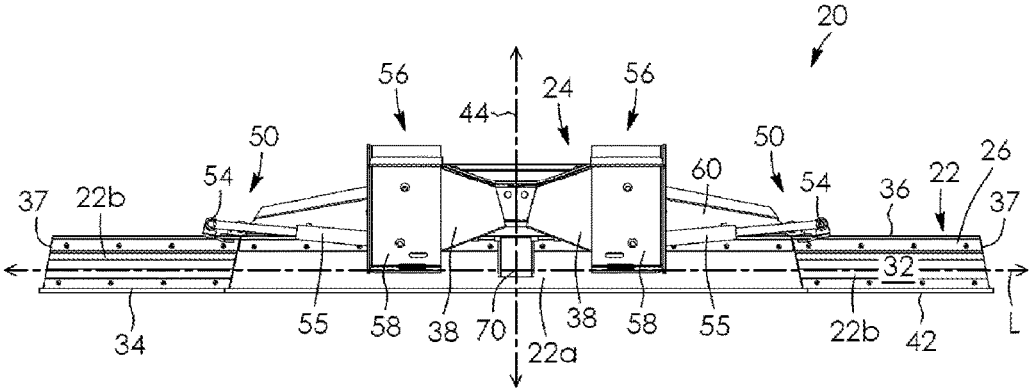
FIG. 3 is a view in rear elevation of the surface-formation equipment illustrated in FIG. 1.
Figure 4:
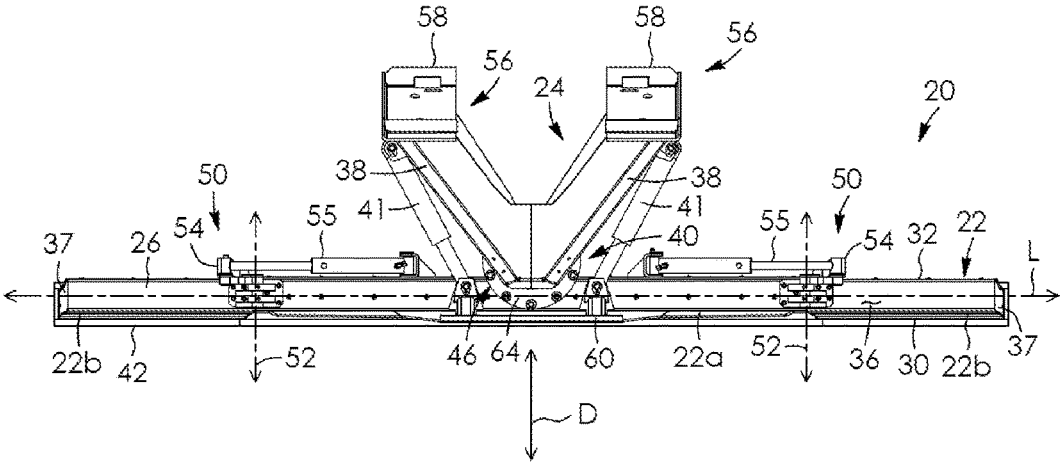
FIG. 4 is a view from above of the surface-formation equipment illustrated in FIG. 1.
Figure 5:
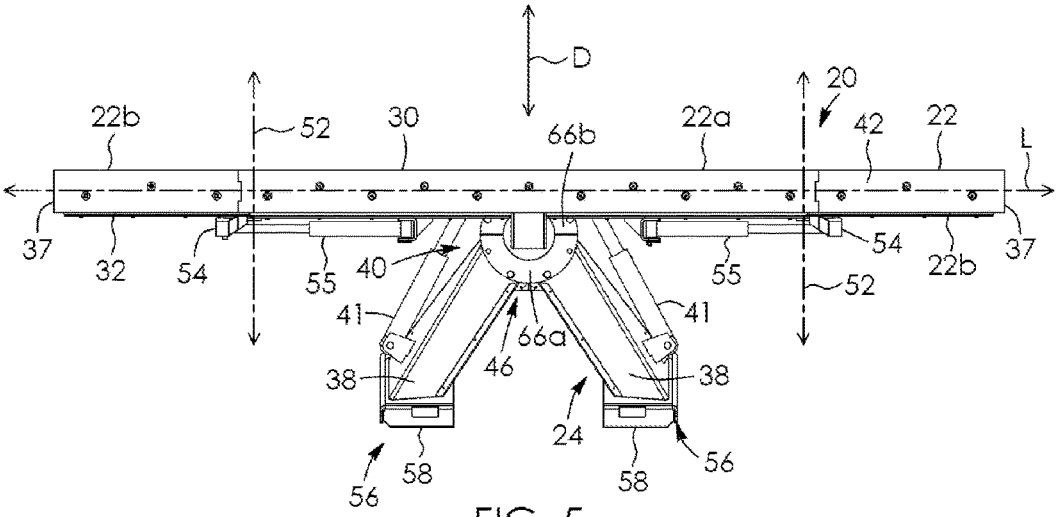
FIG. 5 is a view from beneath of the surface-formation equipment illustrated in FIG. 1.
Figure 6:
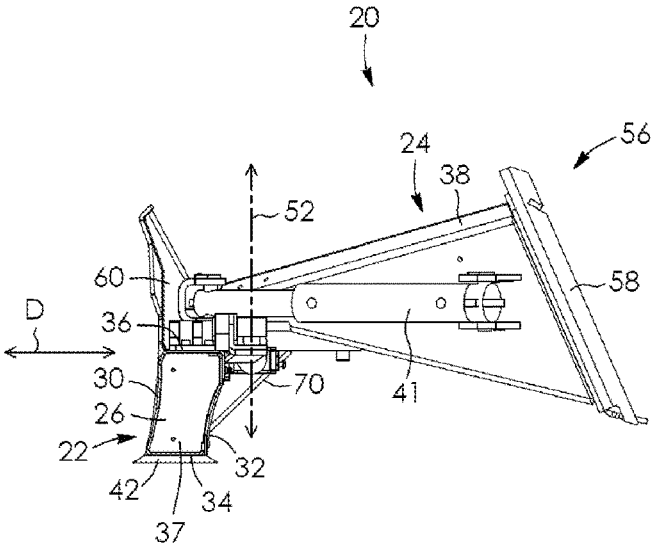
FIG. 6 is a view in side elevation, illustrating the right-hand side, of the surface-formation equipment illustrated in FIG. 1, with the right-hand wing in the unfolded position.

Surface-formation equipment and a method of manufacturing the surface-formation equipment will be described with reference to the figures.

More specifically, with reference to FIGS. 1 to 14, the surface-formation equipment 20 comprises a blade 22 in the overall form of a beam and of which at least one external surface of the blade constitutes a forming (shaping) surface. In one embodiment, the blade 22 includes at least one beam 26 and an external surface of the beam 22 may constitute the or one of the forming surface(s). The surface-formation equipment 20 is configured to be positioned and mounted at the front or at the rear of a mobile unit (not illustrated) (or motorized unit or motive unit) such as, nonlimitingly, units of the caterpillar type (notably of the compact loader type with differential ("skidsteer") steering, tractors and bulldozers operating in the fields of civil engineering, agricultural and/or industrial work.

In one embodiment, the surface-formation equipment 20 also comprises a blade attachment structure 24 connected to this blade 22 and allowing the blade 22 to be mounted at the front or at the rear of a mobile unit. In FIGS. 1 to 14, the attachment structure 24 is configured for mounting the blade 22 at the front or at the rear of the mobile unit. It is configured to allow indirect engagement of the blade 22 with the mobile unit. More particularly, the attachment structure 24 comprises a first end, connected to the blade 22, and a second end, that can be engaged with the mobile unit, at the front of the latter. In one embodiment, the blade 22 attachment structure 24 is connected to the blade 22 by the interposition of a blade-pivoting assembly 40.

In one embodiment, the blade 22, characterized by a longitudinal axis L, can be configured into a plurality of positions. In the present description, these positions are referred to with reference to the direction of travel D of the surface-formation equipment 20 when it is pushed or pulled in a straight line by a mobile unit, which means to say when it is not taking bends. In a first position, referred to as the "straight position", the longitudinal axis L of the blade 22 is oriented substantially perpendicular to the direction of travel D of the equipment 20. In a second position, referred to as the "tilted position", the blade 22 is pivoted, forward or backward, relative to an axis of rotation substantially parallel to the longitudinal axis L of the blade 22 while the blade 22 is in a straight position in a plane making an angle of tilt with the direction of travel of the equipment. In a third position, referred to as the "inclined position", the longitudinal axis L of the blade 22 defines an oblique angle with the direction of travel D of the equipment. An oblique angle is defined as being an angle which is not a right angle (90°) or a multiple of a right angle. In the inclined position, it will be appreciated that the inclination may be oriented to the right or to the left relative to the direction of travel D of the equipment. It will be appreciated that combinations of positions are possible. For example, and nonlimitingly, the blade 22 may be configured into a straight and tilted position or into an inclined and tilted position.

FIGS. 1 to 14 show a first embodiment of the surface-formation equipment 20. The surface-formation equipment 20 comprises a blade 22 and a blade 22 attachment structure 24 mounted at the rear of the blade 22 substantially in the center. The blade 22, having a longitudinal axis L, includes a beam 26 the longitudinal axis of which corresponds to the longitudinal axis L of the blade 22. In the embodiment illustrated, the beam 26 is a beam with a closed profile and, more particularly, having an elongate geometric profile with six surfaces. The six surfaces of the beam 26 include respectively a front surface 30, a rear surface 32, opposite and spaced away from the front surface 30, a lower surface 34 extending between the front 30 and rear 32 surfaces at the lower end of these, an upper surface 36, opposite the lower surface 34 and two lateral surfaces 37 which are spaced apart. In some embodiments, the surface of the blade 22 in contact with the ground is not the lower surface 34. It will be appreciated that, in an alternative embodiment, the beam 26 may be exempt of lateral surfaces 37 and that the beam 26 may be open at the lateral ends 37. It will also be appreciated that, in an alternative embodiment, for a beam with a closed profile, the beam 26 may be exempt of an upper surface 36 so that the front 30 and rear 32 surfaces have an upper edge engaging one another (beam with three surfaces extending along the longitudinal axis L). It will also be appreciated that, in an alternative embodiment, the beam 26 may include more than six surfaces. It will also be appreciated that the beam 26 may be different than a beam with a closed profile. For example and nonlimitingly, the beam may have the profile of the common structural elements including I-section beams, C-section beams, L-section beams, T-section beams, etc.

As mentioned hereinabove, the beam is of elongate shape, which means to say that its greatest dimension is its length dimension. In one embodiment, the length of the beam is at least seven (7) times greater than the height of the beam. In another embodiment, the length of the beam is at least nine (9) times greater than the height of the beam. In one particular embodiment, the length of the beam is approximately eleven (11) times greater than the height of the beam. In one embodiment, the depth of the beam is less than its height. It will be appreciated that, in an alternative embodiment, the depth of the beam is greater than its height. More particularly, in one embodiment, the depth-to-height ratio is of the order of 5/8. In addition, along the longitudinal axis of the beam, the profile thereof may be rectilinear (straight beam) or non-rectilinear (curved beam). In one embodiment, the beam may have a constant or uneven radius of curvature or may even have at least one change in angle along its length.

For a beam with a closed profile, the interior volume of the beam 26 may be filled, part-filled, or empty (or hollow). In one embodiment, in order to reduce the weight of the equipment 20, the interior volume of the beam 26 is predominantly empty (or hollow) but includes a reinforcing structure. In one embodiment, the reinforcing structure comprises a plurality of reinforcing members extending in the interior volume between two walls of the beam 26 defining two surfaces. In one embodiment, the beam 26 may be of the all-welded and/or bonded and/or bolted type.

In the embodiment illustrated, the blade 22 includes a main section 22*a* and two lateral sections 22*b* (referred to as lateral wings 22*b*) which are pivot-mounted to the main section 22*a*, at the ends thereof. Each of the main section 22*a* and the lateral wings 22*b* includes the front surface 30, the rear surface 32, the lower surface 34 and the upper surface 36 of the beam 26. In the embodiment illustrated, the beam 26 of each of the lateral wings 22*b* includes a lateral surface 37 at its distal end (which means to say at its end distant from the main section 22*a*) and at its proximal end (which means to say the end adjacent to the main section 22*a*), whereas the ends of the main section 22*a* of the beam 26 are open. In an alternative embodiment, at least one of the proximal and distal ends of the beam 26 in the lateral wings 22*b* may be open. Also, the ends of the beam 26 in the main section 22*a* may be closed.

In one embodiment, the upper surface 36 in the main section 22*a* is shorter, along the longitudinal axis L, than the lower surface 34. Thus, in the main section 22*a*, the ends are inclined. In the lateral wings 22*b*, the beam 26 may have proximal ends of a shape that substantially complements the ends of the main section 22*a* and, in particular, which are inclined, being longer near the upper surface 36.

In one embodiment, the distal ends of the lateral wings 22*b* may also be inclined, for example in the same direction as the proximal ends of the lateral wings 22*b*. As a result, the lower edge of the distal end protrudes beyond the upper edge toward the outside of the lateral wing 22*b*. It will be appreciated that the angles of inclination of the distal and proximal ends, defined with respect to the lower surface of the blade 22, may be similar or different.

It will be appreciated that, in an alternative embodiment, the ends of the lateral wings 22*b* and/or of the main section may be straight, which means to say not inclined, or substantially vertical.

When the blade 22 is in an unfolded configuration illustrated in FIGS. 1 to 6, as will be described in greater detail hereinbelow, each of the front surfaces 30, of the rear surfaces 32, of the lower surfaces 34 and of the upper surfaces 36 are substantially aligned with the corresponding surface of the other sections so as to define surfaces that are substantially continuous, which means to say that the corresponding surfaces of the various sections 22*a*, 22*b* are substantially in the same plane in the unfolded position.

It will be appreciated that, in an alternative embodiment, at least one of the front surfaces 30, of the rear surfaces 32, of the lower surfaces 34 and of the upper surfaces 36 is able not to be aligned with the corresponding surface of the other sections.

In the embodiment illustrated, the main section 22*a* and the lateral wings 22*b* of the blade 22 have substantially the same profile when viewed in section along a plane of section perpendicular to the longitudinal axis L. Nevertheless, the lateral wings 22*b* are of lesser length than the main section 22*a*, which means to say their length along the longitudinal axis L of the blade 22. In one embodiment, the lateral wings 22*b* have a length less than half the main section 22*b* of the blade 22. It will be appreciated that, in an alternative embodiment, the main section 22*a* and the lateral wings 22*b* of the blade 22 may have a different profile, when viewed in section along a plane of section perpendicular to the longitudinal axis L.

As mentioned hereinabove, the lateral wings 22*b* are pivot-mounted to the main section 22*a* of the blade 22 by a wing-pivoting assembly 50 defining a pivot and allowing pivoting about an axis of pivoting 52. The axes of pivoting 52 of the lateral wings 22*b* extend substantially perpendicular to the longitudinal axis L of the blade 22. In one embodiment, the wing-pivoting assemblies 50 are positioned at least above the upper section of the main section 22*a* of the blade 22 and substantially at the ends thereof. More specifically, they are positioned in such a way that the axis of pivoting 52 extends above a midline of the beam 26, namely closer to the upper surface 36 than to the lower surface 34. In the embodiment illustrated in FIGS. 1 to 14, the axis of pivoting is situated above the upper surface 36 of the beam 26.

More particularly, each of the wing-pivoting assemblies 50 includes a hinge 54 engaged on the upper surface 36 of the main section 22*a* and of a respective lateral wing 22*b*. The hinge 54 is secured to the main section 22*a*, on a first side of the axis of pivoting 52, and to the lateral wing 22*b*, on the other one side of the axis of pivoting 52. As will be described in greater detail hereinbelow, the wing-pivoting assemblies 50 allow the lateral wings 22*b* to be configured in an unfolded position, illustrated in FIGS. 1 to 6, in a fully folded position, illustrated in FIGS. 7 to 12, and in a plurality of intermediate folded positions lying between the unfolded position and the fully folded position.

Although the blade 22 illustrated in FIGS. 1 to 14 is made up of three parts (a main section 22*a* which, in this embodiment, is a central section, and two lateral wings 22*b*), it will be appreciated that, in alternative embodiments, the blade 22 may include a single section and be exempt from lateral wings or alternatively the blade 22 may include a single lateral wing 22*b*, mounted on the right-hand side or on the left-hand side of the main section 22*a*. In another alternative embodiment, the blade 22 may include more than two lateral wings 22*b*. In another alternative embodiment, the blade 22 may include two lateral wings 22*b* connected together and be exempt of a main section 22*a*. Thus, the two lateral wings 22*b* may pivot relative to one another and be configured simultaneously or independently in the deployed position in which they are in contact with the ground and the folded position in which they are predominantly spaced away from the ground (raised).

In addition, in the embodiment illustrated in FIGS. 1 to 6, in the unfolded position, the lateral wings 22*b* are aligned with the main section 22*a*, along the longitudinal axis L, which means to say that a zero angle is defined between these. In an alternative embodiment, in the unfolded position, the lateral wings 22*b* may define an oblique angle with the main section 22*a*. In one particular embodiment, the lateral wings 22*b* may extend forward, in the direction away from the attachment structure 24, with respect to the main section 22*a*.

The wing-pivoting assembly 50 also comprises two actuators 55. One actuator 55 is associated with each of the lateral wings 22*b*. In the embodiment illustrated, the actuators 55 comprise two double-acting (pneumatic, electric or hydraulic) actuating cylinders. It will be appreciated that the actuator may be other than the double-acting (or double-action) actuating cylinder illustrated. For example and non-limitingly, the actuating cylinder may be replaced by a rotary actuator. These have a first end mounted on the rear surface 32 of the main section 22*a* and a second end connected to their respective lateral wing 22*b*, at the rear thereof. More particularly, in the embodiment illustrated, the second end of the actuator 55 is connected to the distal end of the hinge 54, slightly above the upper surface 36.

As mentioned hereinabove, the attachment structure 24 is connected to the blade 22, to the rear thereof. The attachment structure 24 is substantially centered with respect to the length of the blade 22, relative to the longitudinal axis L thereof. In the embodiment illustrated in FIGS. 1 to 6, the attachment structure 24 is characterized by having the overall shape of a V with two arms 38 having a proximal (or front) end connected to the blade 22 and a distal (or rear) end that can be connected to a mobile unit (not illustrated). The proximal ends of the two arms 38 are engaged in one another while the distal ends are spaced apart. When viewed from above (FIGS. 4 and 10) or below (FIGS. 5 and 11), the attachment structure 24 defines a substantially triangular profile.

The surface-formation equipment 20 also comprises an assembly 40 for pivoting the blade 22, mounted at the proximal ends of the arms 38 and allowing the blade 22 to be attached to the attachment structure 24 and, more particularly, to be pivot-attached to the arms 38. More particularly, the pivoting assembly 40 allows the blade 22 to pivot about an axis of pivoting 44 extending substantially vertically and aligned with the center of the pivoting assembly 40. In the embodiment illustrated, the axis of pivoting 44 is situated at the rear of the rear surface 32 of the blade 22, spaced away therefrom. In one embodiment, the pivoting assembly 40 includes a turntable system 46 and the axis of pivoting 44 is situated at the center of the turntable system 46. The pivoting assembly 40 will be described in greater detail hereinbelow.

In one embodiment, the attachment structure 24 is mainly metal. For example, it may be made mainly of steel.

The attachment structure 24 also comprises an attachment structure 56 which, in the embodiment illustrated, includes two plates 58, each being able to be secured to a distal end of one of the arms 38, and mechanical fasteners such as bolts, screws or any other suitable mechanical fastener. This attachment structure 56 allows rapid and adjustable attachment to the chassis of a mobile unit (not illustrated). The height of the surface-formation equipment 20 relative to the mobile unit is adjusted using the attachment structure 24 and, more particularly, using the plates 58, as will be described in greater detail hereinbelow.

The blade 22, including the main section 22*a* and the lateral wings 22*b*, are configured to shape (form) the ground. The front 30 and/or the rear 32 surfaces of the beam 26 may have a straight and/or concave (or hollow) profile or any other suitable profile. Various profiles for the beam 26 will be described hereinbelow with reference to FIG. 15. It will be appreciated that the shape of the front surface 30 may differ from the shape of the rear surface 32. Also, it will be appreciated that the shape of the front surface 30 of the beam 26 in the main section 22*a* may differ from the shape of the front surface 30 of the beam 26 at the lateral wings 22*b*. Similarly, the shape of the rear surface 32 in the main section 22*a* may differ from the shape of the rear surface 32 in the lateral wings 22*b*.

In the embodiment illustrated in FIGS. 1 to 14, the blade 22 also comprises a cutting edge 42, mounted to the beam 26, near the lower surface 34. In the embodiment illustrated and as mentioned hereinabove, the blade 22 includes a main section 22*a* which, in the embodiment illustrated, is located centrally, and lateral wings 22*b*. The cutting edge 42 also includes three parts: a main section, mounted to the beam 26 at the main section 22*a*, and two lateral sections, each one being mounted to the beam 26 at the lateral wings 22*b*. The thickness of the cutting edge 42 is less than the thickness of the beam 26.

The cutting edge 42 extends parallel to the lower surface 34 of the beam 26. It supports the blade 22 on the ground and therefore runs parallel thereto.

In the embodiment illustrated, the cutting edge 42 has a profile of substantially trapezoidal shape and fully covers the lower surface 34 of the beam 26. However, in an alternative embodiment (not illustrated), the cutting edge 42 could have a rectangular profile or be of any other suitable shape. In an alternative embodiment (not illustrated), the cutting edge 42 could be mounted at the periphery of the beam 26, near the lower surface 34 of the beam 26, without necessarily covering it. In an alternative embodiment (not illustrated), the cutting edge 42 partially covers the lower surface 34 of the beam 26.

In the embodiment illustrated, the external edges of the cutting edge 42 are chamfered, forming an acute angle, the cutting edge being wider at the surface for contact with the ground than at the upper surface where it meets the beam 26. The external edges of the cutting edge 42 therefore define an angle with the ground and the lower surface 34 of the beam 26. In the embodiment illustrated, the bottom corners of the cutting edge 42 extend toward the outside of the beam 26, which means to say that the cutting edge 42 has a point projecting toward the outside of the beam 26 and, more particularly, of the lower surface 34 of the beam 26. In various embodiments, the angles of the chamfered edges vary between 20° and 40°.

The cutting edge 42 is pressed against the ground, in the position of rest (or of non-operation) of the equipment 20. It also acts as a gliding and ground-formation surface when the equipment 20 is in operation, which means to say that the cutting edge 42 glides over the ground as the equipment moves. Since the cutting edge 42 is in contact with the granular or liquid materials during operation, this edge is subjected to significant friction. In one embodiment, it is made from a material with high resistance to abrasion, such as a highly abrasion-resistant steel. The acute-angled tip of the cutting edge 42 projecting from the beam 26 makes it easier to penetrate the granular or liquid materials covering the ground.

In one embodiment, the cutting edge 42 has the form of a plate fully covering the lower surface 34 of the beam 26. Predominantly, over its entire periphery, the cutting edge 42 has a chamfered edge protruding beyond the lower end of the beam 26, including at the lateral surfaces 37. In an embodiment in which the blade 22 includes one or more lateral wings, the adjacent ends of the main section 22*a* and/or of the lateral wing 22*b* may be exempt from a chamfered edge, as illustrated in the figures.

The cutting edge 42 may be fixed to the beam 26 using a plurality of mechanical fasteners, such as screws or bolts, or by any other suitable means of attachment, such as, non-limitingly, by welding.

Figure 7:
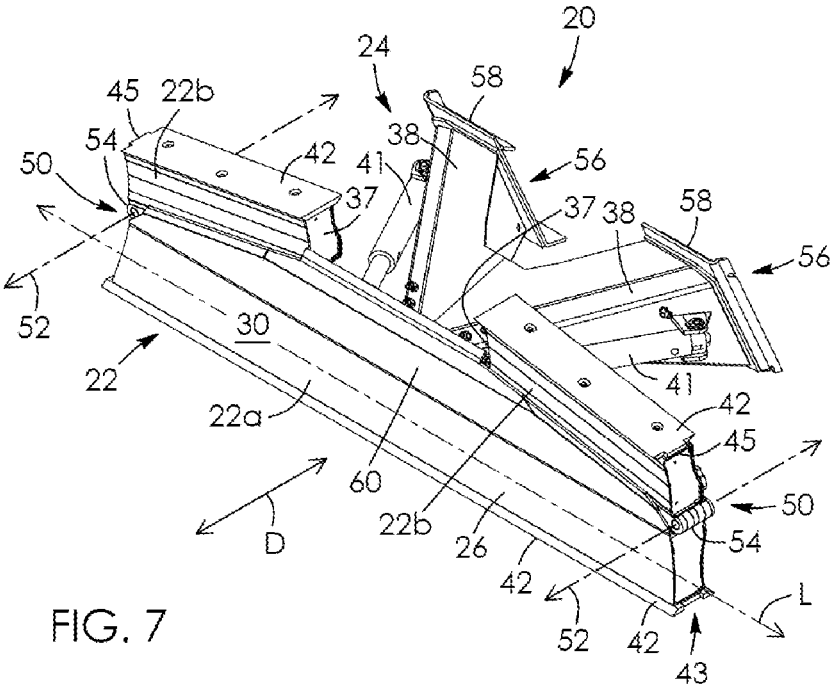
FIG. 7 is a perspective view from front right of surface-formation equipment according to one embodiment, including the two lateral wings configured in the folded (or compact) position.
Figure 8:
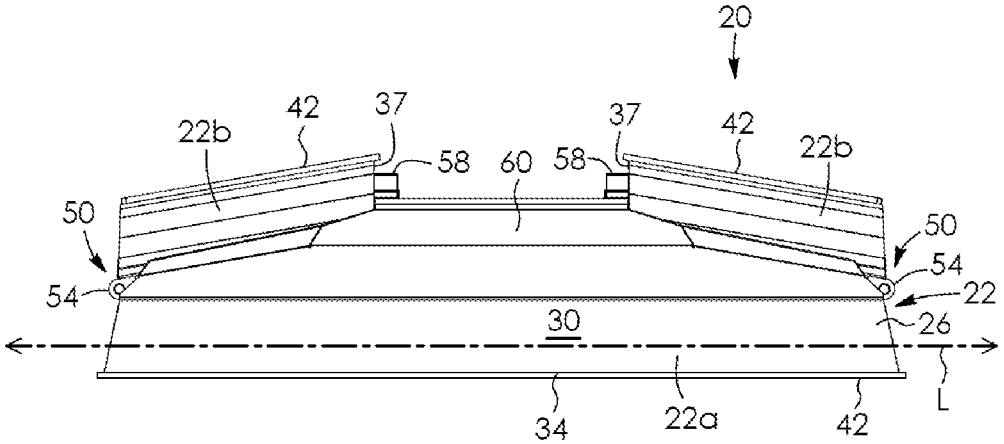
FIG. 8 is a view in front elevation of the surface-formation equipment illustrated in FIG. 7.
Figure 9:
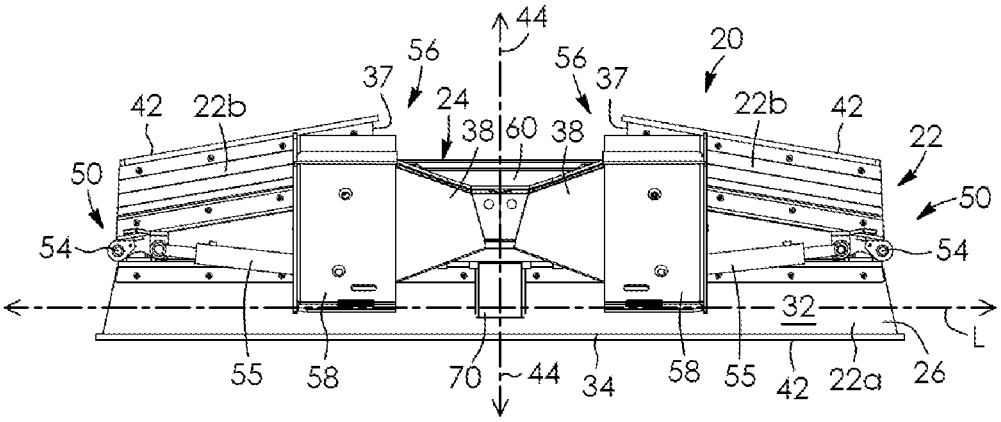
FIG. 9 is a view in rear elevation of the surface-formation equipment illustrated in FIG. 7.
Figure 10:
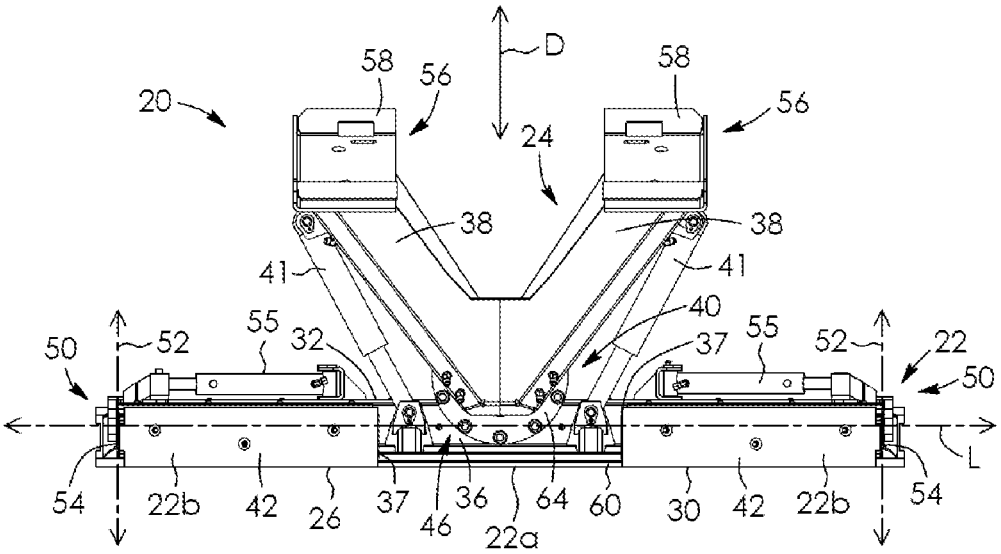
FIG. 10 is a view from above of the surface-formation equipment illustrated in FIG. 7.
Figure 11:
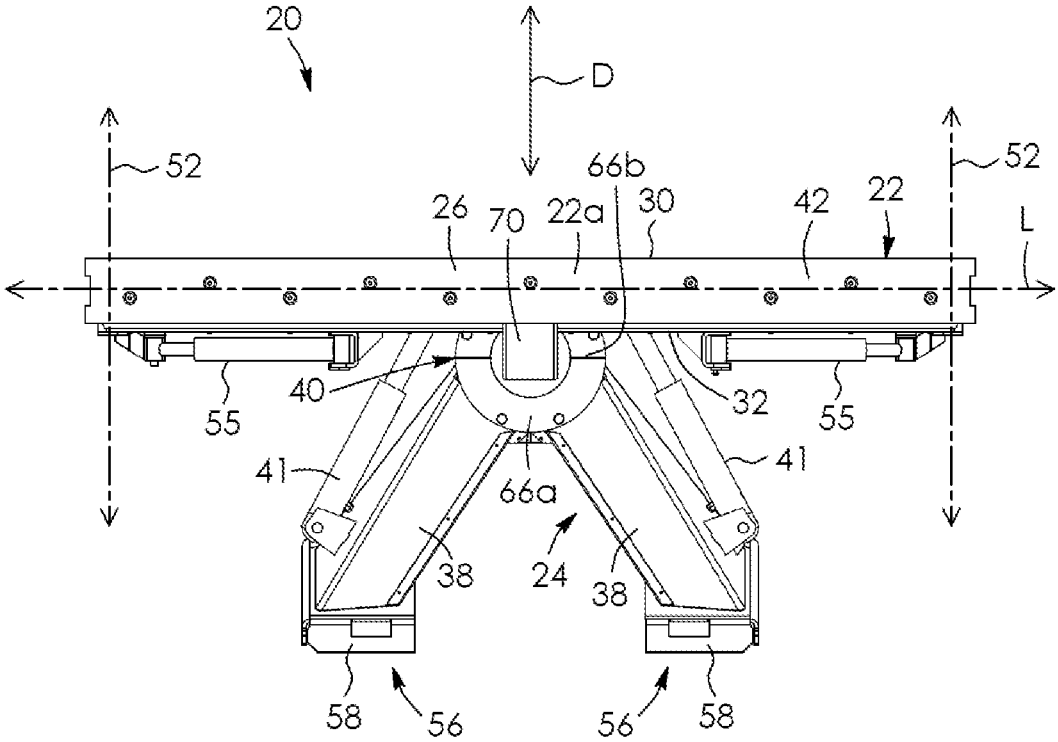
FIG. 11 is a view from beneath of the surface-formation equipment illustrated in FIG. 7.
Figure 14:
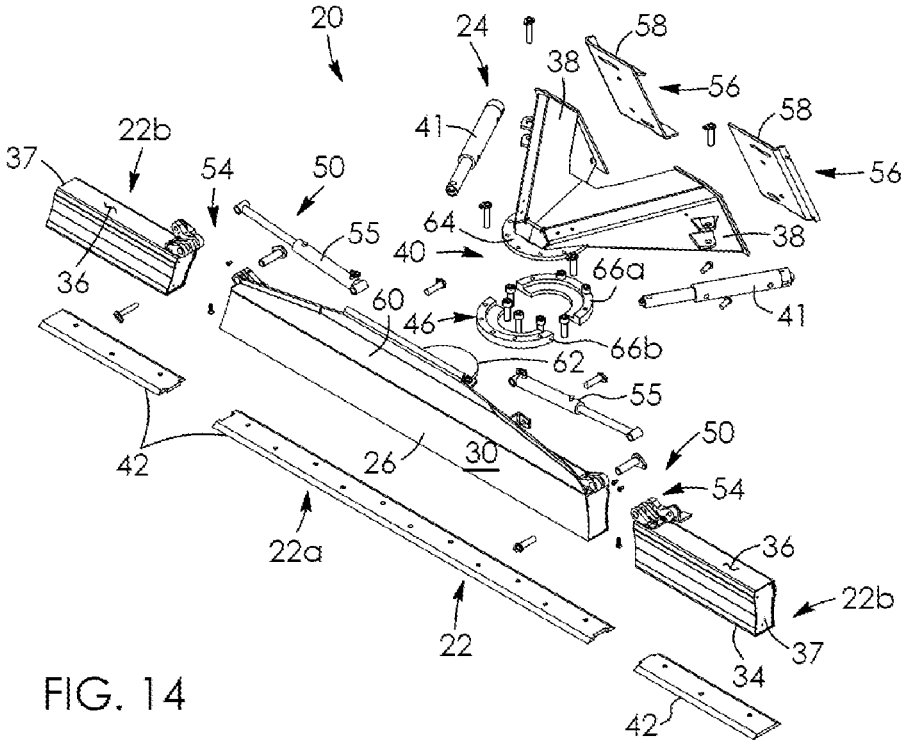
FIG. 14 is an exploded perspective view from front right of the surface-formation equipment illustrated in FIG. 1.

In the embodiment in which the blade 22 includes a plurality of sections, the lateral ends of the lateral sections of the cutting edge 42 may be provided with connections of the male/female type that can engage in one another when the blade 22 is in the unfolded configuration. More specifically, FIGS. 7 and 14 show that the ends of the cutting edge 42 of the main section 26*a* include a recess 43 (female connection) whereas the proximal ends of the lateral wings 26*b* include a protuberance 45 (male connection) that complements the recess 43 and can be engaged therein when the respective lateral wing 22*b* is in the unfolded configuration. The male/female type connections at the cutting edge 42 reduce the risks of the lateral wing 22*b* pivoting backward or forward during the operation of the equipment 22. It will be appreciated that, in an alternative embodiment, the male/female-type connections may be reversed on the main section 26*a* and the lateral wings 26*b*. It will also be appreciated that the shape and configuration of the male/female-type connections may vary from the embodiment illustrated.

It will be appreciated that, in certain embodiments, the cutting edge 42 may be exempt of a connection of the male/female type.

In one embodiment, in the unfolded configuration, the lateral wings 22*b* are slightly spaced away from the main section 22*a*.

In the folded embodiment illustrated in FIGS. 7 and 14, the ends of the beam 26 in the main section 22*a* are exposed, which means to say are not closed off. In an alternative embodiment, the ends of the beam 26 in the main section 22*a* may be closed off by an end-wall, thus preventing granular or liquid material from entering the interior volume of the beam 26 if this beam is at least partially hollow.

In one embodiment, the blade 22 has a planar lower surface. This may be the lower surface of the cutting edge 42 which completely covers the beam 26. It may also be the lower surface of the cutting edge 42 which is substantially aligned with the lower surface 34 of the beam 26 which is at least partially exposed. In one embodiment, the lower surface of the blade 22 is substantially exempt of cavities, except for the mechanical fasteners, if any.

In one embodiment, when the blade 22 is in the unfolded position, the lower surface of the blade 22 at the lateral wing 22*b* and of the main section 22*a* defines a single plane, which means to say that the lower surface of the blade 22 at the lateral wing is substantially in the same plane as the lower surface of the blade 22 at the main section 22*a*.

It will be appreciated that, in an alternative embodiment, the blade 22 may be exempt of a cutting edge 42 and that the surface via which the blade 22 contacts the ground may be the lower surface 34 of the beam 26.

As mentioned hereinabove, the lateral wings 22*b* of the blade 22 are pivot-mounted to the main section 22*a*. More particularly, they can pivot between an unfolded position (FIGS. 1 to 6 and 13) and a plurality of folded positions. FIGS. 7 to 12 illustrate the blade 22 in one of the possible folded positions and, more particularly, in the fully folded position. In the unfolded position, the lateral wings 22*b* are aligned with the main section 22*a*, which means to say that the angle defined between the longitudinal axis of the main section 22*a* and the longitudinal axis of the lateral wings 22*b* is zero. It will be appreciated that, although the two lateral wings 22*b* are configured in a folded position in FIGS. 7 to 12, just one of the lateral wings 22*b* can be configured in a folded position while the other lateral wing 22*b* can be configured in an unfolded position. It will also be appreciated that the positions of the lateral wings 22*b* in the folded position may differ. In the present description, the folded position of a lateral wing 22*b* is defined by the angle defined between the longitudinal axis of the main section 22*a* and the longitudinal axis of said lateral wing 22*b*. In the fully folded position, the lateral wings 22*b* press against the upper surface 36 of the main section 22*a*, and this approximately doubles the height of the pushing surface of the blade 22. This increase in the height of the pushing surface of the blade 22 allows a relatively large quantity of granular material to be moved around using the equipment 20, as will be described in greater detail hereinbelow.

The possibility of selectively configuring the blade 22 in a plurality of folded positions and one unfolded position makes it possible to reduce the risk of breaking structures and/or infrastructures by rubbing. The folded position of the lateral wing 22*b*, namely the angle defined between the longitudinal axis of the main section 22*a* and the longitudinal axis of said lateral wing 22*b*, can be adjusted as need be. The intermediate folded positions between the unfolded position and the fully folded position may prove useful in certain applications.

In the embodiment illustrated, the surface-formation equipment 20 also comprises a deflector 60. The deflector 60 includes a plate of substantially trapezoidal shape extending upward from the upper surface 36 of the beam 26 near the meeting point with the front surface 30. In the embodiment illustrated, the deflector 60 is mounted only on the main section 22*a*. However, in an alternative embodiment, the lateral flange or flanges 22*b* may also include a deflector. For example and nonlimitingly the deflector may be mounted near the rear surface 32 of the blade 22 or alternatively the blade 22 may include two deflectors: a front deflector and a rear deflector. The shape and configuration of the deflector 60 may vary from the embodiment illustrated. The deflector 60 increases the area of equipment 20 available when pushing a large quantity of granular material.

In the fully folded position shown in FIGS. 7 to 12 and in the folded positions approaching this position, the lateral wings 22*b* provide support for the deflector 60. More particularly, the lateral wings 22*b* are positioned to the rear of the deflector 60 and the latter can rest against them when the load being moved around is great. As a result, they reduce the possibility of the deflector 60 becoming bent or damaged during a surface formation operation.

The pivoting assembly 40 will now be described in greater detail with reference to FIG. 14. This assembly allows the blade 22 to be pivot-connected to the tip of the attachment structure 24. It defines an axis of pivoting 44 about which the blade 22 can pivot relative to the direction of travel D of the equipment 20. It comprises a turntable system 46 including a central disk 62 fixedly mounted on the blade 22 and extending to the rear thereof, a support surface 64 and, more particularly, an upper plate mounted on the arms 38 at the proximal end thereof and fixedly, and two securing pieces and, more particularly, hoops 66*a*, 66*b*. As mentioned above, the pivoting assembly 40 ensures that the blade 22 can pivot between the straight position and the inclined positions and the axis of pivoting 44 is substantially aligned with the center of the turntable system 46.

In the embodiment illustrated, the central disk 62 is substantially circular in shape and substantially T-shaped in profile. It is secured centrally to the top of the beam 26 and, more particularly, to the center of the main section 22*a*. The upper plate 64, likewise in the form of a disk, is also circular. Part of it protrudes forward beyond the tip defined by the two arms 38. More specifically, it is secured to the lower surface of the two arms 38.

The two hoops 66*a*, 66*b* complement one another in shape. They are configured and arranged to trap the central disk 62 between them and the upper plate 64. More specifically, in the assembled configuration, the central disk 62 extends and, more particularly, is contained, between the upper plate 64 and the two hoops 66*a*, 66*b*, with the upper plate 64 extending above the central disk 62 and the two hoops 66*a*, 66*b* extending below. More particularly, the hoops 66*a*, 66*b* are secured to the upper plate 64 using mechanical fasteners such as, and nonlimitingly, screws and bolts. Thus, the central disk 62 can pivot in the space defined between the upper plate 64 and the hoops 66*a*, 66*b*.

In order to reduce the friction between the central disk 62, the upper plate 64 and the hoops 66*a*, 66*b* during pivoting, labyrinth seals (not illustrated) as well as a number of grease nipples (not illustrated) are arranged symmetrically over the cavity of the turntable system 46.

In a complementary or alternative embodiment, the contacting surfaces of the various components of the turntable system 46 including the central disk 62, the upper plate 64 and the hoops 66*a*, 66*b*, may be covered with or made from a material having a low coefficient of friction so as to reduce the friction between the components during pivoting and that has a resistance to wear. For example, and nonlimitingly, the components of the turntable system 46 may comprise Nylatron®.

In an alternative embodiment (not illustrated), the upper plate 64 could be a part or surface for support of the V-shaped attachment structure 24 defined by the arms 38.

The pivoting assembly 40 described hereinabove makes it possible to obtain a pivoting mechanism that is more stable than a single pivot rod and that is also less inclined to premature wear than pivot rods or an assembly including a rolling mechanism (i.e. rings). Thus, the pivoting assembly 40 described hereinabove will be appreciated for the durability it affords. It will be appreciated that, in alternative embodiments (that have not been illustrated), other known pivoting assemblies could be used for the equipment 20. For example and nonlimitingly, known alternatives that could be used include pivoting assemblies using a rack, an annular gear, a rod and rings.

The pivoting assembly 40 also comprises two actuators 41 and, more particularly, two actuating cylinders (hydraulic, electric or pneumatic or electric actuating cylinders). In one embodiment, the actuating cylinders 41 are actuating cylinders of the "single-acting" (or single action) type providing hydraulic release in the event of thrust exceeding the traction capability of the mobile unit. Thus, in one embodiment, the actuating cylinders 41 are provided with a device that manages the resistance to thrust applied to the blade 22 during operation. It will be appreciated that the actuators 41 may be something other than actuating cylinders.

Figure 13:
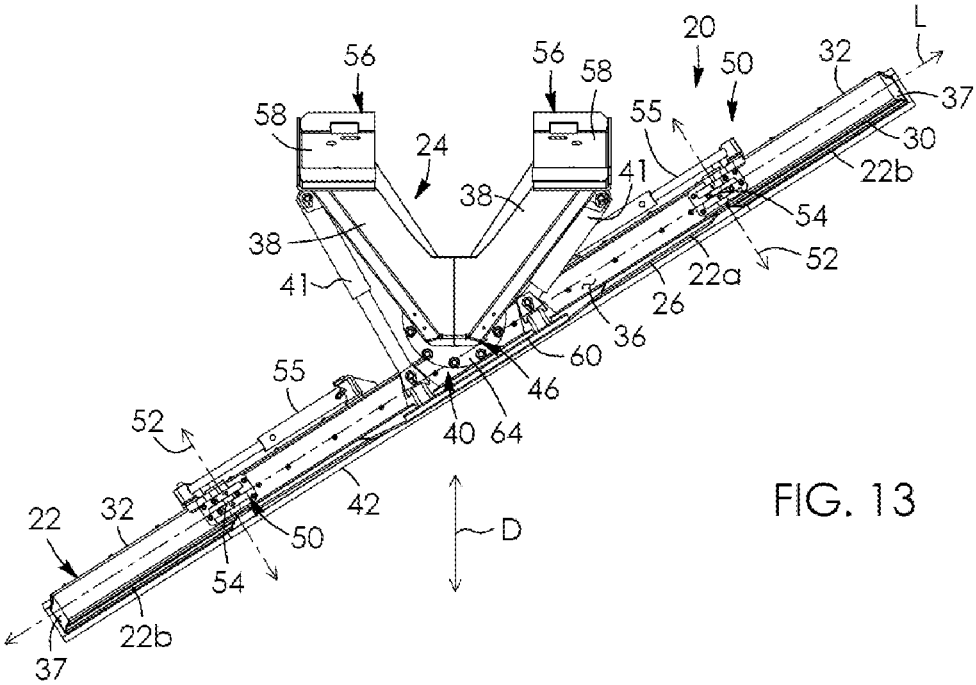
FIG. 13 is a perspective view from above of the surface-formation equipment illustrated in FIG. 1 in which the beam defines an oblique angle with the direction of travel of the surface-formation equipment when mounted on a mobile unit (not illustrated)

Each of the actuating cylinders 41 is associated with one of the arms 38 of the attachment structure 24 and with one of the sides of the blade 22, which means to say that a first actuating cylinder 41 is mounted on the right-hand side of the equipment 20, relative to the attachment structure 24 and to the pivoting assembly 40, while a second actuating cylinder 41 is mounted on the left-hand side of the equipment 20. They have a first end mounted on one of the respective arms 38 and a second end mounted on the blade 22. In the embodiment illustrated, the second end of the actuating cylinders 41 is connected to the upper surface 36 of the beam 26 at the main section 22*a*. These actuating cylinders 41 can be actuated selectively so as to allow the blade 22 to be pivoted to the right or to the left, relative to the direction of travel D of the equipment 20, as illustrated in FIG. 13. The actuating cylinders 41 can therefore be actuated in order to modify the configuration of the blade 22 between the straight position and one of the inclined positions or between two inclined positions. It will be appreciated that the actuators of the pivoting assembly 40 may differ from the actuating cylinders 41 illustrated.

In order to reduce the risks of breakage and limit slipping of the caterpillar tracts or wheels of the mobile unit on the ground, an oil valve device is incorporated into the hydraulic system of the actuating cylinders 41.

It will be appreciated that the beam-pivoting assembly 40 can be used as a pivoting mechanism allowing pivoting between two components other than the blade 22 and the attachment system 24. In such an embodiment, the central disk is fixedly mounted to a first of the two components. It may be an intrinsic part of the first component. The upper plate 64 may be replaced by a support surface on the second component, which may also be a disk. Finally, one or more securing piece(s) such as the hoops, are secured to the support surface with the central disk extending between the two and preventing disengagement of the central disk. Thus, the central disk can pivot between the support surface and at least one securing piece. The specific features of the embodiment described hereinabove, in relation to the surface-formation equipment, apply to the pivot mechanism allowing pivoting between two components.

In one embodiment, the pivoting assembly allows the blade to be inclined up to 30° on each side, relative to the direction of travel D.

Figure 12:
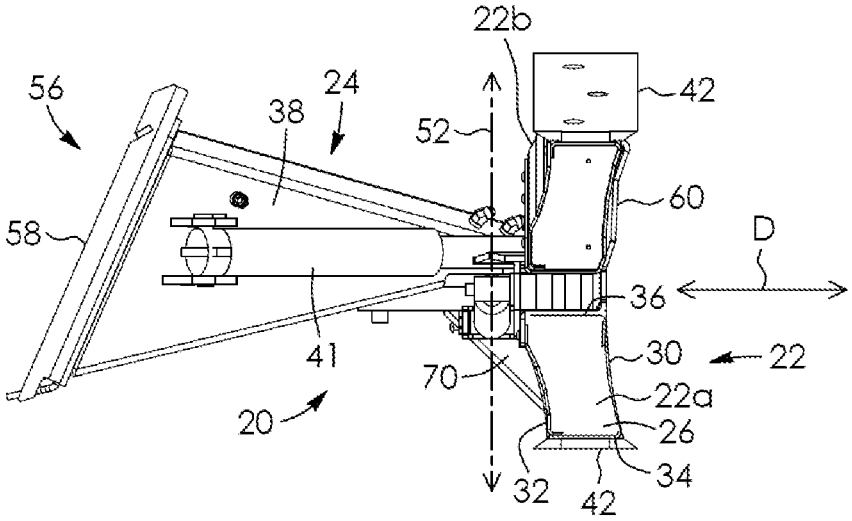
FIG. 12 is a view in side elevation, illustrating the left-hand side, of the surface-formation equipment illustrated in FIG. 7, with the right-hand wing in the folded position.

With reference to FIG. 12, in order to reduce the risks of knocking over the blade 22, which risks may be occasioned by the positioning of the assembly 40 for pivoting the blade 22 in the upper section of this blade, the attachment structure 24 also comprises a reinforcer 70 (or angular reinforcer) in the form of an angle bracket. This reinforcer 70 is positioned to the rear of the main section 22*a*, centrally with respect to the blade 22. More specifically, it is secured to the rear surface 32 of the main section 22*a* and to the central disk 62. In one embodiment, the reinforcer 70 extends almost to the point where the rear surface 32 and the lower surface 34 of the beam 26 meet, slightly above the cutting edge 42. It allows force of thrust (or of the load) coming from the mobile unit (not illustrated) to be transferred to the pivoting assembly 40 and at the same time toward the lower section of the blade 22, thus reducing the risk of knocking over (or tipping over). The reinforcer 70 acts as a brace between the turntable system 46 that makes the connection between the arms 38 defining a generally V-shaped support, and the main section 22*a* of the blade 22.

Various profiles of the blade 22 including the beam 26 and the cutting edge 42 will be described with reference to FIG. 15. It will be appreciated that the profiles described hereinabove may apply both to the main section 22*a* and to the lateral wings 22*b* of the blade 22.

FIGS. 15*a* to 15*e* illustrate possible profiles for closed-profile beams. In all the embodiments illustrated in FIGS. 15*a* to 15*e*, the beams 26 are geometric profiles having six surfaces of which four surfaces 30, 32, 34 and 36 define the shape of the beam 26 when viewed in cross section. It will be appreciated that the front and rear surfaces 30, 32 may have a profile that is straight (which means to say without curvature) or concave (which means to say hollow), the radius of curvature of which may be constant or irregular.

Figure 15A:
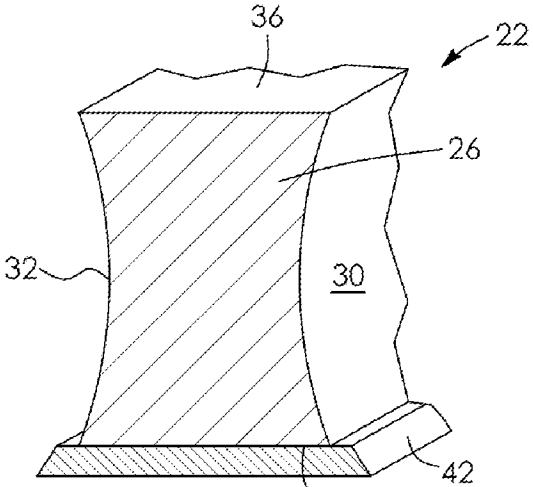
FIG. 15 includes FIGS. 15*a*, 15*b*, 15*c*, 15*d*, 15*e*, 15*f* and 15*g* which are cross-sectional views of various embodiments of a blade for the surface-formation equipment illustrated in FIG. 1.

In the embodiment of FIG. 15*a*, the lower and upper surfaces 34, 36 are planar and extend substantially parallel to one another. The front and rear surfaces 30, 32 are concave in shape and characterized by a radius of curvature that is substantially uniform along the respective surface 30, 32. In the embodiment illustrated, the radius of curvature of the front surface 30 is substantially equal to the radius of curvature of the rear surface 32. The cutting edge 42 is of substantially rectangular shape and protrudes beyond the front and the rear surfaces 30, 32 of the beam 26. The edges of the cutting edge 42 are right angles.

Figure 15B:
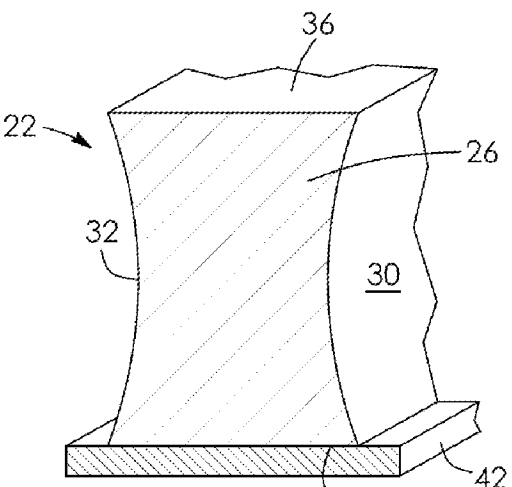

In the embodiment of FIG. 15*b*, the shape of the beam 26 is substantially similar to that of FIG. 15*a*. However, the cutting edge 42 has chamfered edges protruding between the lower surface 34 of the beam 26. More specifically, the cutting edge 42 has a substantially trapezoidal profile and the depth of the upper surface of the cutting edge 42 is greater than the depth of the lower surface 34 of the beam 26.

Figure 15C:
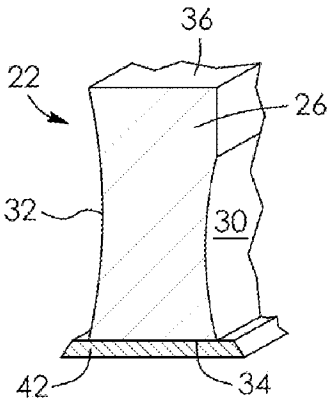

In the embodiment of FIG. 15*c*, the shape of the cutting edge 42 and of the rear surface 32 of the beam are substantially similar to what is shown in FIG. 15*b*. However, the front surface 30 of the beam 26 is divided into two sections: a substantially planar section in the upper section followed by a lower section of concave shape the radius of curvature of which is substantially uniform.

Figure 15D:
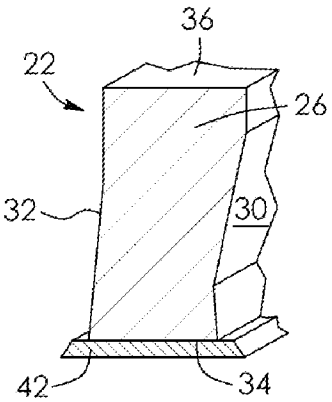

In the embodiment of FIG. 15*d*, the shape of the cutting edge 42 is substantially similar to those in FIGS. 15*b* and 15*c*. However, the front and rear surfaces 30, 32 differ. The front surface 30 of the beam 26 is divided into three sections: an upper section, an intermediate section and a lower section. All the sections are substantially planar. However, the upper section protrudes forward in comparison with the lower section and the two sections are oriented substantially perpendicular to the lower and upper surfaces 34, 36. The intermediate section connects the upper and lower sections. The rear surface 32 of the beam 26 is divided into two substantially planar sections: an upper section and a lower section. The upper section is oriented substantially perpendicular to the lower and upper surfaces 34, 36. The lower section extends at an angle rearward, which means to say in the direction away from the front surface 30.

Figure 15E:
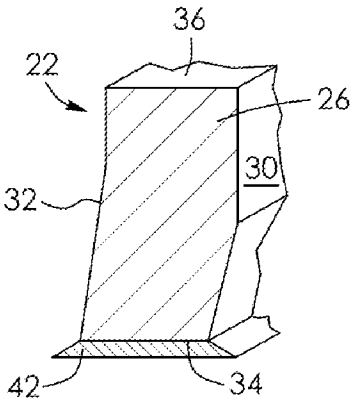

In the embodiment of FIG. 15*e*, the shape of the cutting edge 42 is substantially similar to those of FIGS. 15*b*, 15*c* and 15*d*. The front surface 30 of the beam 26 is divided into two substantially planar sections: an upper section and a lower section. The upper section is oriented substantially perpendicular to the lower and upper surfaces 34, 36. The lower section extends at an angle rearward, which means to say toward the rear surface 32. The shape of the rear surface 32 is similar to the rear surface 32 of FIG. 15*d* except that the upper section is of smaller height. In addition, in the embodiment of FIG. 15*e*, the depth of the upper surface of the cutting edge 42 is substantially similar to the depth of the lower surface 34 of the beam 26 and only the chamfered tips extend beyond the lower surface 34 of the beam 26 toward the front and toward the rear.

It will be appreciated that numerous modifications may be made to the embodiments described hereinabove. In addition, combinations of the various embodiments may be glimpsed. For example and nonlimitingly, the lower and upper surfaces 34, 36 may be non-planar and/or not extend substantially parallel to one another. Of the front and rear surfaces 30, 32 at least one could be convex in shape. In addition, the radius of curvature of the front surface 30 can differ from the radius of curvature of the rear surface 32.

Figure 15G:
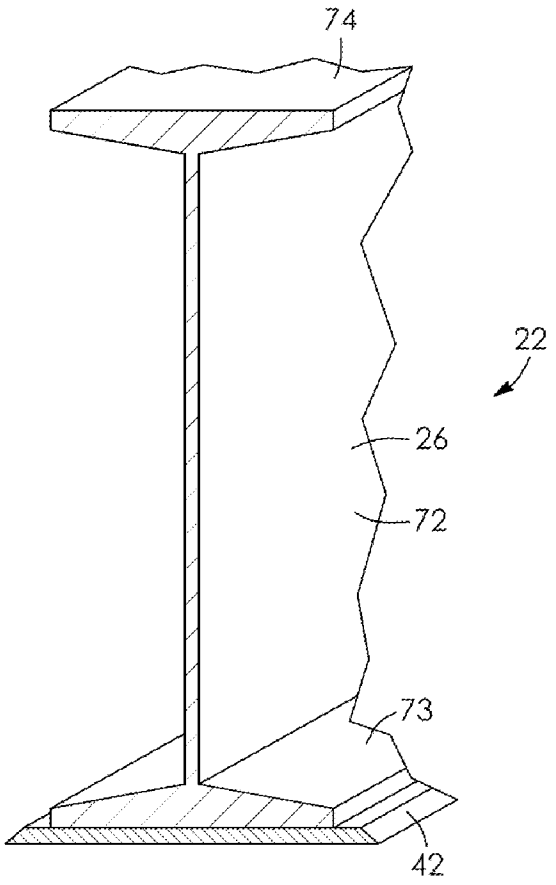
Figure 15F:
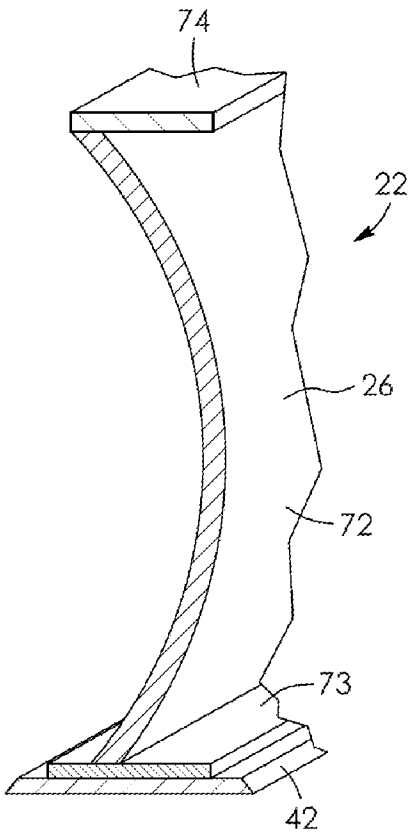
Figure 16:
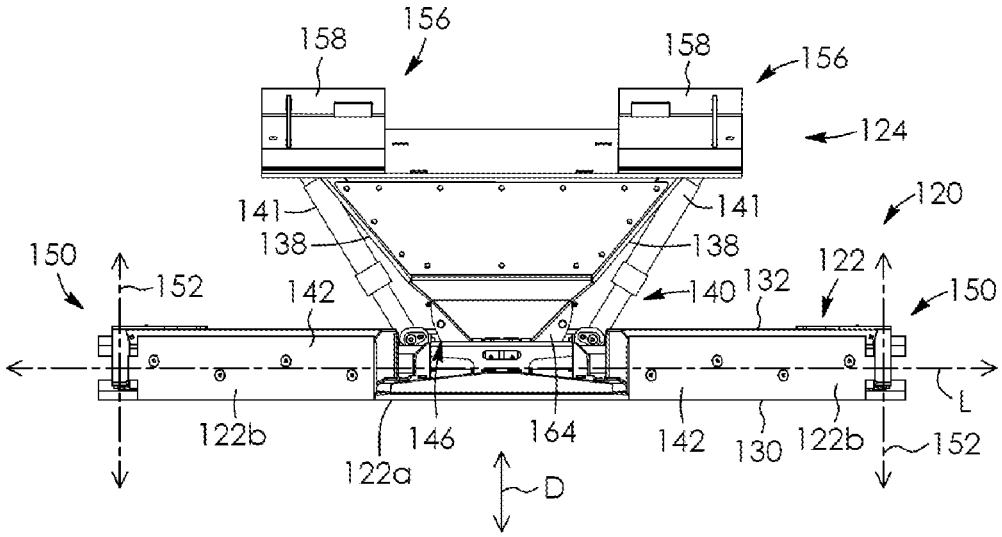
FIG. 16 is a view from above of surface-formation equipment according to another embodiment, in which the lateral wings are connected to the main section by an articulation system and in which the lateral wings are configured in the folded position.
Figure 17:
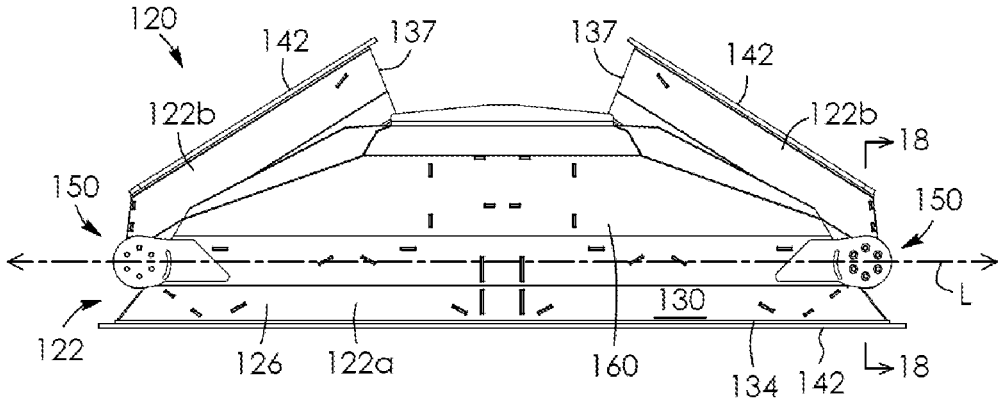
FIG. 17 is a view in front elevation of the surface-formation equipment illustrated in FIG. 16.
Figure 18:
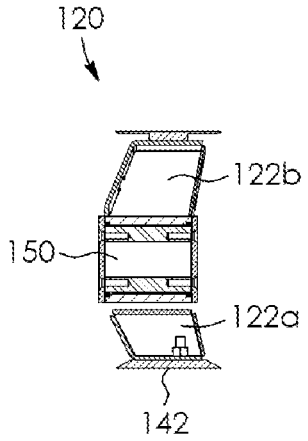
FIG. 18 is a view in section on A-A of FIG. 16 of the surface-formation equipment illustrated in FIG. 16.
Figure 19:
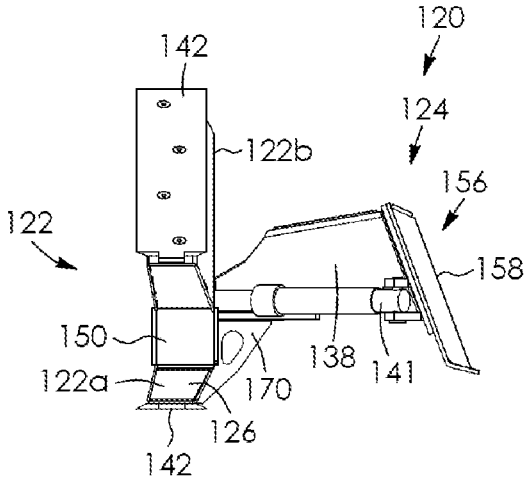
FIG. 19 is a view in side elevation, illustrating the right-hand side, of the surface-formation equipment illustrated in FIG. 16, with the right-hand wing in the folded position.
Figure 20:
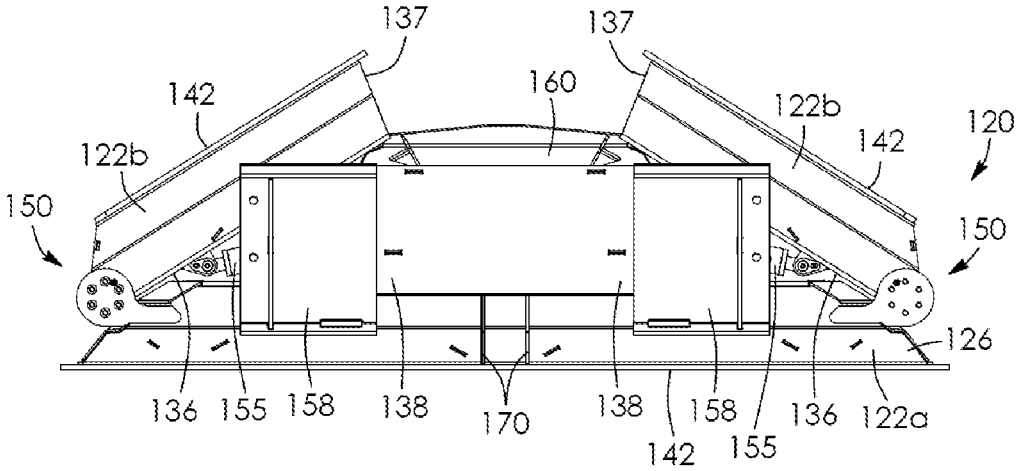
FIG. 20 is a view in rear elevation of the surface-formation equipment illustrated in FIG. 16.
Figure 21:
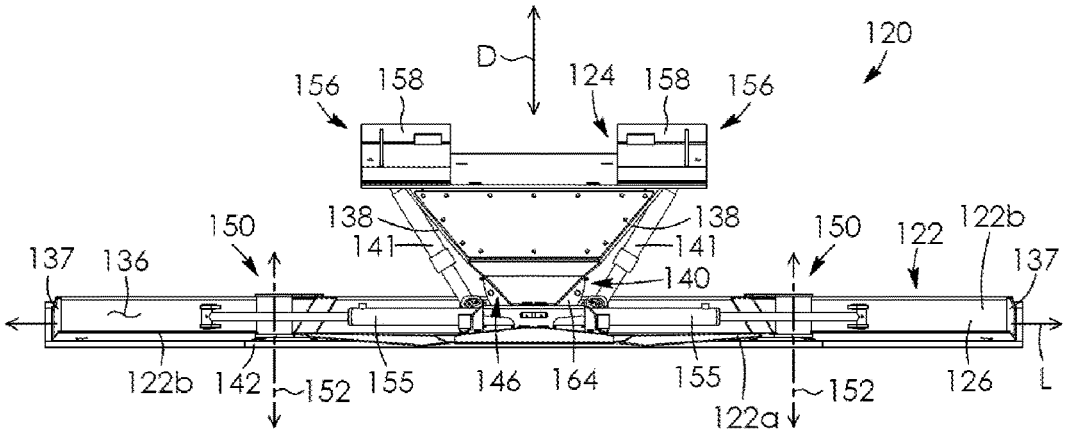
FIG. 21 is a view from above of the surface-formation equipment illustrated in FIG. 16, in which the lateral wings are configured in the unfolded position.
Figure 22:
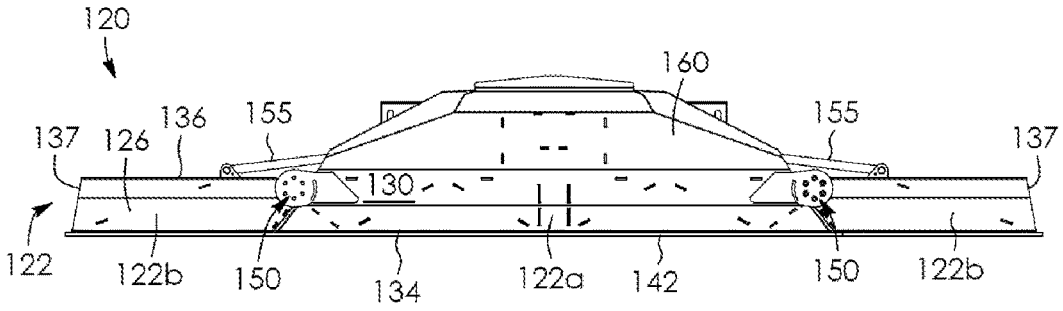
FIG. 22 is a view in front elevation of the surface-formation equipment illustrated in FIG. 21.
Figure 23:
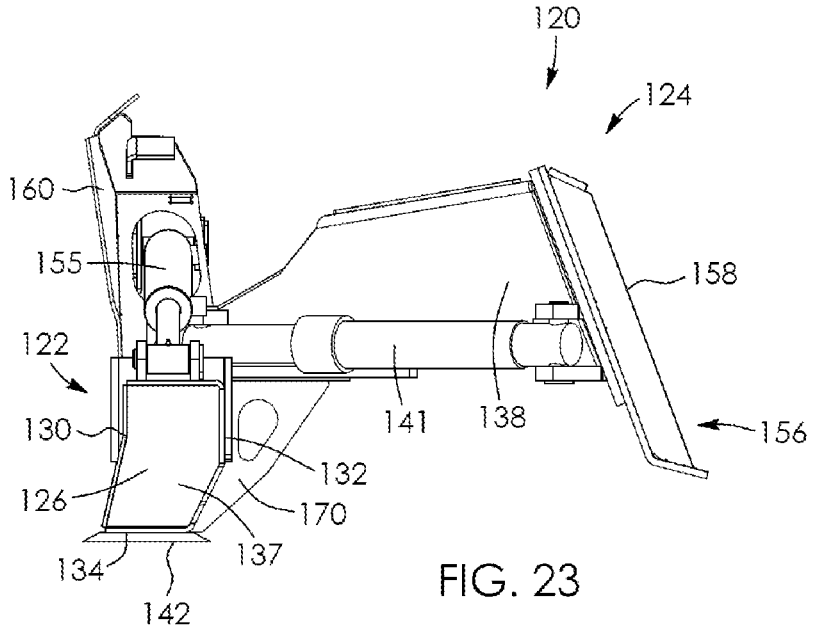
FIG. 23 is a view in side elevation, illustrating the right-hand side, of the surface-formation equipment illustrated in FIG. 21, with the right-hand wing in the unfolded position.

FIGS. 15*f* and 15*g* illustrate two possible embodiments of profiles for beams that are not closed-profile beams. In the embodiments of FIGS. 15*f* and 15*g*, the shape of the cutting edge 42 is substantially similar to those in FIGS. 15*b*, 15*c*, 15*d* and 15*e*.

In the embodiment of FIG. 15*f*, the beam 26 is a compound of a C-section beam and an I-section beam. It comprises a web 72 having a curved profile extending between a lower flange 73 and an upper flange 74 which are planar. The lower flange 73 extends on each side of the web 72 whereas the upper flange 74 extends only forward, its rear end being aligned with where it meets the web 72.

In the embodiment of FIG. 15*g*, the beam 26 is a compound of an I-section beam comprising a web 72 of straight profile extending between a lower flange 73 and an upper flange 74 which are planar.

It will be appreciated that numerous modifications may be made to the embodiments of FIGS. 15*f* and 15*g* described hereinabove. In addition, combinations of the various embodiments may be glimpsed. For example and nonlimitingly, the lower and upper flanges 73, 74 may be non-planar and/or not extend substantially parallel to one another. In addition, the webs 72 may have a curvature or may be straight. Also, the beams may have no upper flange 74.

In the embodiments illustrated in FIGS. 15*a* to 15*g*, the thickness of the cutting edge 42 may vary between ⅜ of an inch and 1 inch approximately. In one embodiment, the depth of the cutting edge 42 may vary between 6 inches and 10 inches.

In one embodiment, the cutting edge is a plate of substantially rectangular shape having chamfered or straight edges. It may also be a strip mounted at the periphery of the beam 26, a series of teeth positioned side by side, of inverse teeth situated side by side or alternatively any other appropriate form including partially rounded or fully rounded profiles. In one embodiment, the cutting edge 42 exceeds the beam 26 at the lower surface 34 thereof. In one particular embodiment, the cutting edge 42 protudes beyond the beam 26 at the lower surface 34 at the front surface 30 and the rear surface 32.

An alternative embodiment of the surface-formation equipment 20 will be described with reference to FIGS. 16 to 24 in which the components are numbered with reference numerals that correspond to those of the previous embodiment, but in the 100s series. In the embodiment of FIGS. 16 to 25, the majority of the components are similar to those described hereinabove with reference to FIGS. 1 to 14. However, the lateral-wing-pivoting assembly 150 differs from the one described hereinabove.

Figure 24:
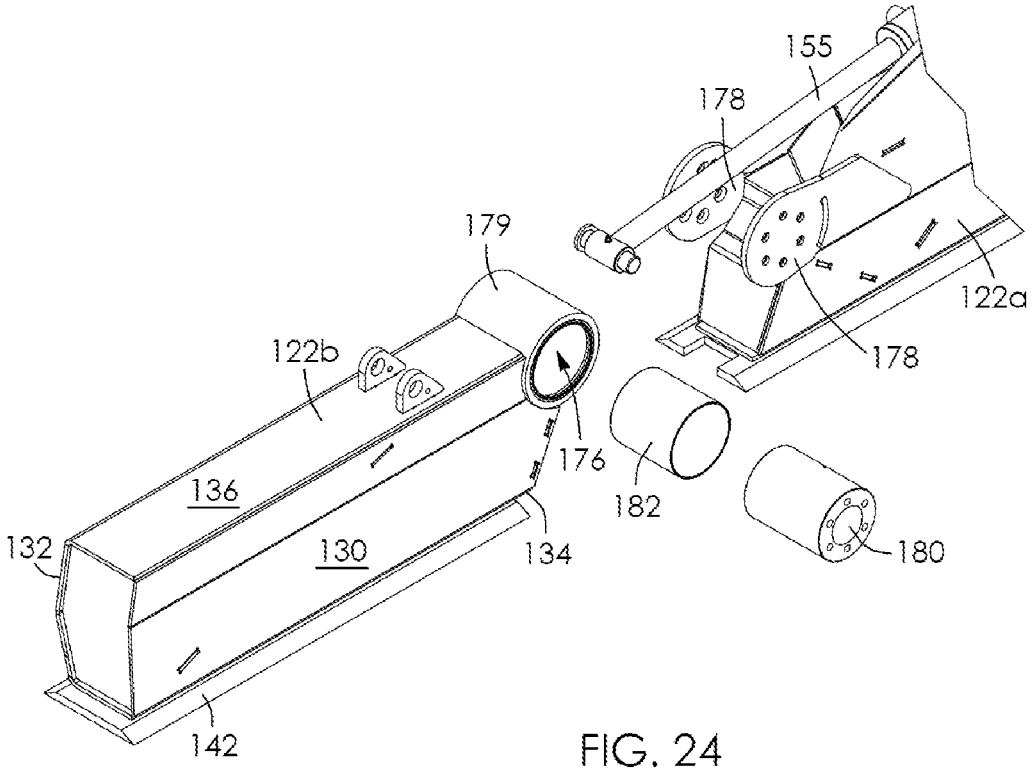
FIG. 24 is an exploded and enlarged perspective view of the articulation system of the surface-formation equipment illustrated in FIG. 21.

More particularly, with reference to FIG. 24, at the lateral ends of the main section 122*b*, the hinges 54 are replaced by an articulation system including a cylindrical cavity 176 defined by an outer ring 179 including a cylindrical peripheral wall. The cylindrical cavity 176 is formed in the lateral wings 122*b* and with the outer ring 179 extending slightly above the upper surface 136 of the lateral wing 122*b* and protruding laterally beyond the respective proximal lateral surface. The lateral surface of the lateral wing 122*b* is of a shape that is inclined toward the lower surface 134, the upper surface 136 extending beyond the lower surface 134 at the proximal end. The ends of the main section 122*a* are of a shape that substantially complements the proximal end of the respective lateral wing 122*b*. More particularly, the lateral surface is of a shape that is inclined toward the upper surface 136, the lower surface 134 extending beyond the upper surface 136 at the end. At their proximal end, in the region of the upper surface 136, the main section 122*a* includes two plates 178, which are spaced apart and the shape of which corresponds substantially to the shape of the openings of the cylindrical cavity 176. The peripheral wall defining the cylindrical cavity 176 and the two plates 178 define the fixed components of the articulation system. When assembled, the plates 178 are positioned on a respective side of the cylindrical cavity 176 and close this cavity.

Mobile components of the articulation system are inserted into the cylindrical cavity 176 and between the plates 178. More specifically, a core 180, surrounded by an inner ring 182, is inserted into the cylindrical cavity 176. In one embodiment, the core 180 and the inner ring 182 are replaceable when worn. In an alternative embodiment, the inner ring 182 may comprise a plurality of inner ring sections which are arranged side by side at the periphery of the core 180. In an alternative embodiment, the articulation system may be exempt of ring(s) 182. For example, the core 180 may be made from or covered with a material having a low coefficient of friction so as to reduce the friction between the components during pivoting and that has resistance to wear. For example and nonlimitingly, the components of the turntable system 46 may comprise Nylatron®. It may also have undergone a suitable heat treatment to give it a low coefficient of friction and a relatively high resistance to wear.

The plates 178 are secured to the core 180 and prevent the core 180 from being extracted from the cylindrical cavity 176. The inner ring 182 is made of a material that encourages pivoting by reducing friction.

In one embodiment, the cylindrical cavity 176 has been formed by machining the lateral wing 122*b*. In an alternative embodiment, the peripheral wall defining the cylindrical cavity 176 can be fixed removably to the lateral wings 122*b*. In one alternative embodiment, the cylindrical cavity 176 may be formed in the main section 122*a* while the lateral wings 122*b* may include the two plates 178.

Just like the lateral-wing-pivoting assembly 50, the lateral-wing-pivoting assembly 150 comprises two actuators 155, one actuator 155 being associated with each of the lateral wings 122*b*. In the embodiment illustrated, the actuators 155 also comprise two double-acting actuating cylinders. For example and nonlimitingly, the actuating cylinder may be replaced by a rotary actuator. It will be appreciated that the actuators 155 may differ from the double-acting actuating cylinder illustrated. These have a first end mounted on the upper surface of the beam 126 at the main section 122*a* and a second end connected to their respective lateral wing 122*b*, on the upper surface 136 thereof. More specifically, in the embodiment illustrated, the second end of the actuator 155 is spaced away from the cylindrical cavity 176 toward the distal end of the respective lateral wing 122*b*.

The surface-formation equipment 20, 120 may also comprise a control mechanism (not illustrated) such as a control mechanism of the joystick type. This stick may be manipulated by the operator, for example the operator of the motorized-type mobile unit to which the surface-formation equipment 20, 120 is connected in order to control the position of the lateral wings 22*b*, 122*b* and the position of the blade 22, 122, namely its inclination with respect to the direction of travel D (straight or inclined). More particularly, the actuators 41, 55, 141, 155 of the assembly 40, 140 for pivoting the blade 22, 122 and the wing-pivoting assembly 50, 150 may be connected operationally to the control mechanism by hydraulic and/or electrical connectors. The control mechanism may also include electrical controls that allow the various actuators of the surface-formation equipment 20, 120 to be actuated.

The surface-formation equipment 20, 120 described hereinabove may be manufactured using a manufacturing method including known means of assembly including welding, bonding, riveting, socket fitting, crimping, screwing and combinations of at least two of these means of assembly.

As mentioned hereinabove, the surface-formation equipment 20, 120 may be secured detachably to a mobile unit to form an operational motorized assembly made up of surface-formation equipment as described hereinabove, secured removably or permanently (non-removably) to a mobile unit. In one embodiment, the mobile unit may be a motorized unit of the type having caterpillar tracks (notably of the compact loader type with differential (skidsteer) steering) or those marketed by the company Caterpillar® and BobCat®. In one embodiment, the mobile unit is equipped with a device that allows the blade 22, 122 of the equipment 20, 120 to be tilted forward or backward.

In one embodiment, for a predetermined motorized unit, surface-formation equipment 20, 120 having a blade 22, 122 of which the length (including the lateral wings 22*b*, 122*b*) is 1.6 to 2 times the length of the motorized unit that can be selected.

In order to mount the surface-formation equipment 20, 120 to a mobile unit, the attachment structure 56, 156 is attached to the chassis of the mobile unit. For example, the equipment 20, 120 may be secured by the interposition of the plates 58, 158 on appropriate supports of the chassis, optionally pivotable so as to allow the blade 22, 122 to be tilted.

When mounted to a mobile unit, the height of the surface-formation equipment 20, 120 is adjusted so that the lower surface of the blade 22, 122, namely the lower surface of the cutting edge 42, 142 or the lower surface 34, 134 of the beam 26, 126 in the main section 22*a*, 122*a*, is in the same plane as the point of traction on the ground of the mobile unit, namely the lower surface in contact with the ground. This may be the point of contact with the ground of the wheels or of the caterpillar tracks of the mobile unit. Thus, in a rest position and on a planar and straight surface, the lower surface of the blade 22, 122 is in the same plane as the traction surface or point of the mobile unit, which means to say the surfaces that support the mobile unit on the ground. This configuration at the time of assembly of the surface-formation equipment 20, 120 to the mobile unit, referred to as the "zero position" or "zero point" means that the blade 22, 122 has some float over the ground during operation. Thus, when mounted to the mobile unit, the float of the blade 22, 122 can be maintained without the aid of electronic devices, such as a laser, electrical, hydraulic or other devices. This float also allows the ground to be shaped with the surface-formation equipment 20, 120 at a relatively high speed of travel. The equipment 20 "floats" over the ground without necessarily being in "floating mode", which means to say the mode incorporated into several mobile units in which there is no mechanical or hydraulic pressure applied to the ground save for the intrinsic weight of the equipment 20, 120.

It has been noted that adjusting the height of the blade 22, 122 relative to the level of the traction surface of the mobile unit, when both are resting on a planar surface, allows the surface-formation results to be improved significantly both in terms of the speed of travel and of execution and in terms of the quality of the surface formed.

In a number of embodiments, the surface-formation equipment 20, 120 is mounted on a section of the chassis of a mobile unit the inclination of which can be modified. Thus, the operator of the mobile unit may modify the inclination of the chassis and thus pivot the blade 22, 122 about an axis extending substantially parallel to its longitudinal axis L, when this blade is configured in its straight position, namely substantially perpendicular to the direction of travel D of the equipment 20, 120. Thus, the blade 22, 122 may be configured in a tilted position, tilted either forward or backward, and the angle of attack of the cutting edge 22, 122 or of the lower surface 34, 134 of the blade 22, 122 can thus be modified.

In several embodiments, the surface-formation equipment 20, 120 is mounted on a section of the chassis the elevation of which can be modified. More particularly, as mentioned hereinabove, the surface-formation equipment 20, 120 is mounted on the chassis at the minimum height, namely in the "zero" position. However, in certain embodiments, the position of the section of the chassis may be adjustable upward, which means to say that it is possible to raise the surface-formation equipment 20, 120 above the "zero" position during operation. It may also be possible to lower the surface-formation equipment 20, 120 below the "zero" position during operation.

In one embodiment, the blade 22, 122 has a low profile, and a height that allows its center of gravity to be positioned substantially below the center of gravity of the mobile unit in which it is attached.

The surface-formation equipment 20, 120 described hereinabove can be used in the field of the shaping of ground covered in liquid or granular materials including, nonlimitingly, surfacing, leveling and the shifting of granular material.

When the surface-formation equipment 20, 120 is mounted to a motorized unit, the latter may travel over a wide range of speeds and, in certain situations, the maximum speed of travel of the motorized unit has been able to be achieved while at the same time pushing along the surface-formation equipment 20, 120 mounted at the front and maintaining a high quality shaping of the surface. For example, during surface-shaping with the equipment 20, 120, a speed of travel varying from a very low speed up to a speed of 20 km/h may be achieved. These speeds are achieved thanks to the high degree of float and to the substantially planar lower surface of the blade 22, 122, which minimize the risks of "false moves" and make it more difficult for the blade 22, 122 to be dug inappropriately into the ground. Specifically, because of the float, the risks of "wrong moves" or of a maneuvering error are substantially reduced.

Also, the pressure exerted on the ground by the blade 22, 122 and, mainly via the pressure that exists on the ground, allows a visual identification of the zones with different levels of compaction, which means to say makes it possible to distinguish between the more compacted zones of the ground and the less compacted zones. Indeed it is known within the field that the visual appearance of the worked surface differs according to its degree of compaction. For that reason, the cutting edge 42, 142, made from a material with high resistance to abrasion, makes it possible to visually discern the more compacted zones of the ground from the less compacted zones. Thus, the operator can rework the surface that is to be shaped until the sought after compaction uniformity is obtained according to the type of granular material and the quality required. In this way it is possible to reduce and/or eliminate the subsequent use of compaction equipment such as compression rollers.

The cutting edge 42, 142, with a chamfered edge, also allows the surfaces to be profiled while at the same time maintaining the "floating" effect of the blade 22, 122 traveling over the ground.

In addition, because of the fact that the lateral wings 22*b*, 122*b* can be configured between the folded and unfolded positions, the shaping width that can be achieved is variable. In one embodiment, a width of twelve (12) feet has been obtained. In addition, the fact that the lateral wings 22*b*, 122*b* can be configured between the folded and unfolded positions means that angular and rounded slopes can be formed. This configurability also allows the surface-formation equipment 20, 120 to be transported laterally when moving along the highway. More particularly, in order to reduce the width of the surface-formation equipment 20, 120 when traveling by road, the lateral wings 22*b*, 122*b* are configured into the fully folded position, thus making it possible to reduce the width of the equipment 20, 120 without reducing the width that can be achieved when shaping a surface.

In this way, the assembly 40, 140 for pivoting the blade 22, 122 allows the blade to be configured into a plurality of inclined positions and thus allows work to be performed in tight spaces.

The surface-formation equipment 20, 120 is multifunctional and can be used for carrying out finishing work and for pushing granular materials, often in relatively high quantities. Thus it is possible to use it to carry out work normally performed with a motorized vehicle fitted with a bucket.

Although it has been mentioned that in one embodiment the blade 22, 122 has a length that may be as high as twelve feet, it will be appreciated that blades of smaller and larger dimensions may be designed. For example, blades of larger dimensions may be designed and assembled on motorized units of greater capacity, such as bulldozers. Models may also be adapted to other types of motorized units such as, nonlimitingly, hydraulic excavators.

The surface-formation equipment 20, 120 may be used for creating complex shapes, which means to say for forming complex profiles, because of these numerous components including the lateral wings 22*b*, 122*b* which can be configured, simultaneously or independently, between an unfolded position and a plurality of folded positions, because of the adjustment of the inclination of the blade 22, 122 relative to the direction of travel D of the equipment 20, 120 and because of the tilting of the blade 22, 122 (modifying the fore-aft inclination). The surface-formation equipment 20, 120 allows the creation of profiles with composite angles on the ground and of rounded profiles. In this context, the actuators 41 of the assembly 40 for pivoting the blade 22, 122 allow lateral action and the actuators 55 of the assembly 50, 150 for pivoting the lateral wings 22*b*, 122*b* make it possible to define a non-linear and modifiable profile using the blade 22, 122, the lateral wings 22*b*, 122*b* being able to be moved by pivoting about respective axes of pivoting 52, 152.

The surface-formation equipment 20, 120 can be used to create shapes in tight spaces, namely to shape tight spaces, because of the low profile of the blade 22, 122 and because of the ability to pivot the blade 22, 122 in order to modify its inclination relative to the direction of travel D of the equipment 20, 120.

The surface-formation equipment 20, 120 can be used to push relatively large quantities of granular material. As described hereinabove, when the lateral wings 22*b*, 122*b* are in the folded configuration, and using the deflector 60 fixed to the main section 22*a*, 122*a*, relatively large quantities of granular material can be pushed. As mentioned hereinabove, the deflector 60 may rest on the lateral wings 22*b*, 122*b* which are configured into a folded position, so as to prevent this deflector from deforming. In certain applications, the surface-formation equipment 20, 120 can be used to replace the buckets normally used.

When connected to a mobile unit the blade 22, 122 may be propelled in the forward direction and the backward direction, namely by a movement forward or backward of the mobile unit. It has been found that surface-formation is achieved rapidly in both directions of travel.

The surface-formation equipment 20, 120 is also suitable for instances of heavy work, such as the work for which apparatus of the bulldozer and agricultural or industrial tractor type are intended.

The surface-formation equipment 20, 120 can be used for shaping surfaces, including surfacing, leveling, moving granular material, but also for demolishing structures and for clearing snow and ice.

To sum up, the surface-formation equipment 20, 120 notably has at least one of the following advantages:

1. multifunctionality to shape surfaces of planar and rounded shape and to push granular material;

2. a working capacity that is modifiable thanks to the folding lateral wings which widen the field of action in the unfolded position and that allow significant quantities of material to be pushed around in the folded position;

3. high-speed leveling capability because the base of the blade is seated on a cutting edge with a planar lower surface equipped with chamfered edges that very effectively limit the risk of inappropriate "digging" into the ground;

4. high versatility because the blade allows shaping to be performed with one or two lateral wings positioned individually in the unfolded position or in the folded position;

5. pivoting assembly of the blade that allows tight spaces to be reached and improves the stability on the ground (triangulation relative to the caterpillar tracks of a mobile unit);

6. pivoting assembly of the blade including a turntable system that reduces premature wear and affords maximum stability;

7. blade-pivoting actuators including pivoting actuating cylinders of the "single acting" type that provide hydraulic release when thrust exceeds the traction capability of the mobile unit;

8. a design that allows ground surfaces to be shaped very close up to objects or obstacles;

9. a two-way leveling capability, which means to say an ability to move forward and backward; and 10. the possibility of leveling spaces of limited height (for example near an overhanging wall of a dwelling).

In addition, although the embodiments of surface-formation equipment and components thereof consist of certain geometric configurations as explained and described hereinabove, only a portion of these components and geometries is essential and so the majority thereof must not be interpreted as implying restriction. As will be apparent to a person skilled in the art, other components and collaborations therebetween, as well as other geometric configurations, can be used for the surface-formation equipment as briefly explained hereinabove and such as a person skilled in the art is able to infer. In addition, it will be appreciated that the positions in the description such as "above", "below", "on the left", "on the right" and other similar positions are to be interpreted within the context of the figures, unless specified otherwise, and must not be considered to be limiting.

Several alternative embodiments and examples have been described and illustrated hereinabove. The above described embodiments of the invention are only examples. A person skilled in the art will assess the features of the individual embodiments and the possible combinations and variations of the components. A person skilled in the art will also appreciate that any one of the embodiments may be achieved in any combination with the other embodiments described hereinabove. It will be appreciated that the invention can be achieved in other specific forms without departing from the spirit or the main features thereof. The examples and embodiments described are to be considered in all aspects as being illustrative and nonrestrictive, and the invention is not limited to the details given. Thus, although specific embodiments have been illustrated and described, numerous modifications are apparent without departing from the spirit of the invention. The scope of the invention is thus limited only by the scope of the claims.

The invention claimed is:

1. A surface-formation equipment, comprising:

a blade including a beam with a profile having the shape of a geometric profile that is elongated along a longitudinal axis, having at least three surfaces extending along the longitudinal axis, including a front surface, a rear surface and a lower surface extending between the front and rear surfaces and defining an interior volume between the at least three surfaces, the blade comprises a cutting edge secured to the beam and covering the lower surface of the beam, the lower surface of the cutting edge being in contact with a surface to be formed during the use of the surface-formation equipment; and an attachment structure defining a substantially triangular profile and having a proximal end connected to the blade and a distal end configured to be attached to a mobile unit, the attachment structure comprising at least two mobile unit engaging plates provided at the distal end and being longitudinally spaced-apart from one another.

2. The surface-formation equipment as claimed in claim 1, in which the cutting edge protrudes beyond the lower surface of the beam at at least one of the front surface, the rear surface, and lateral ends of the beam, wherein the profile of the beam is a closed profile.

3. The surface-formation equipment as claimed in claim 1, in which the cutting edge fully covers the lower surface of the beam, has a surface area greater than a surface area of the lower surface of the beam, and has a thickness less than a height of the beam.

4. The surface-formation equipment as claimed in claim 1, in which the cutting edge has an edge that is chamfered along the longitudinal axis and the chamfered edge forms an acute angle with a tip of the cutting edge projecting outwardly of the beam.

5. The surface-formation equipment as claimed in claim 1, wherein the attachment comprises two arms which are engaged with one another at their proximal end and spaced apart from one another at their distal end with the at least two mobile unit engaging plates extending substantially parallel to the longitudinal axis.

6. The surface-formation equipment as claimed in claim 1, comprising a blade-pivoting assembly connected to the blade and to the attachment structure and allowing the blade to be pivoted between a straight position in which a longitudinal axis of the blade is oriented substantially perpendicular to a direction of travel of the surface-formation equipment and a plurality of inclined positions in which the longitudinal axis of the blade defines an oblique angle with the direction of travel of the surface-formation equipment, and wherein the blade-pivoting assembly pivots about a pivoting axis of the blade, substantially aligned with a center of the blade along the longitudinal axis thereof and substantially perpendicular thereto, spaced-apart from the rear of the blade and extending substantially vertically.

7. The surface-formation equipment as claimed in claim 6, in which the pivoting assembly comprises a turntable system including a first disk, mounted fixedly to the blade and extending rearwardly from the blade, a support surface at the proximal end of the attachment structure, and at least one securing piece secured to the support surface with the first disk extending between the two and preventing the disengagement of the first disk, the first disk being able to pivot between the support surface and the at least one securing piece about the pivoting axis of the blade, aligned with the center of the turntable system.

8. The surface-formation equipment as claimed in claim 1, in which the interior volume defined inside the beam is substantially empty and the beam comprises an internal reinforcing structure including at least one reinforcing member extending in the interior volume between two of the at least three surfaces.

9. The surface-formation equipment as claimed in claim 1, in which the beam has a length of at least seven times greater than a height of the beam, and a depth of which is less than the height.

10. The surface-formation equipment as claimed in claim 1, wherein at least one of the front surface and the rear surface of the beam is concave.

11. The surface-formation equipment as claimed in claim 1, in which the blade comprises a main section and two lateral wings pivotally-connected to a respective end of the main section, each one of the two lateral wings comprises a wing-pivoting assembly mounted at the respective end of the main section, in an upper section of the beam.

12. A mobile unit having a point of traction on the ground comprising the surface-formation equipment as claimed in claim 1 attached thereto, wherein the lower surface of one of the cutting edge and the beam is in a same plane as the point of traction on the ground of the mobile unit.

13. A mobile unit having a point of traction on the ground comprising the surface-formation equipment as claimed in claim 1 attached thereto, wherein the lower surface of one of the cutting edge and the beam is in a same plane as the point of traction on the ground of the mobile unit when mounted to the mobile unit with the blade being tiltable backward or forward, or backward and forward about a tilting axis extending substantially parallel to the longitudinal axis.

14. A motorized surface-formation equipment comprising:

a motorized unit having a traction surface for contact with the ground; and the surface-formation equipment as claimed in claim 1 mounted to the motorized unit, wherein the lower surface of the cutting edge of the surface-formation equipment and the traction surface of the motorized unit are substantially in a same plane.

15. The surface-formation equipment as claimed in claim 1, wherein the lower surface of the cutting edge is substantially planar.

16. The surface-formation equipment as claimed in claim 11, wherein, when the at least one lateral wing is in an unfolded configuration, a lower surface of the at least one lateral wing is in the same plane as the lower surface of a main section so as to form a continuous surface for contact with the ground.

17. The surface-formation equipment as claimed in claim 11, wherein the adjacent ends of the at least one wing and of the main section are inclined and of substantially complementing shapes.

18. The mobile unit as claimed in claim 13, wherein the surface-formation equipment attached to the mobile unit at a minimal height when the lower surface of one of the cutting edge and the beam is in a same plane as the point of traction on the ground of the mobile unit.

19. A motorized surface-formation equipment comprising:

a motorized unit having a traction surface for contact with the ground; and the surface-formation equipment as claimed in claim 1 mounted to the motorized unit, wherein the lower surface of the cutting edge of the surface-formation equipment and the traction surface of the motorized unit are substantially in a same plane when mounted to the motorized unit with the blade being tiltable forward or backward, or forward and backward about a tilting axis extending substantially parallel to the longitudinal axis.

20. The surface-formation equipment as claimed in claim 19, in which the cutting edge protrudes beyond the lower surface of the beam at at least one of the front surface, the rear surface and lateral ends of the beam.

21. The surface-formation equipment as claimed in claim 19, in which the cutting edge fully covers the lower surface of the beam and has a surface area greater than the surface area of the lower surface of the beam, and wherein the lower surface of the cutting edge is substantially planar.

22. The surface-formation equipment as claimed in claim 19, in which the cutting edge has an edge that is chamfered along the longitudinal axis and the chamfered edge forms an acute angle with a tip of the cutting edge projecting outwardly of the beam.

23. The surface-formation equipment as claimed in claim 19, in which the cutting edge has a thickness less than a height of the beam, the interior volume defined inside the beam is substantially empty and comprises an internal reinforcing structure including at least one reinforcing member extending in the interior volume between two of the at least three surfaces, and the beam has a length of at least seven times greater than a height of the beam, and a depth of which is less than the height.

24. The surface-formation equipment as claimed in claim 19, comprising:

an attachment structure having a proximal end connected to the blade and a distal end configured to be attached to a mobile unit; and a blade-pivoting assembly connected to the blade and to the attachment structure and allowing the blade to be pivoted between a straight position in which a longitudinal axis of the blade is oriented substantially perpendicular to a direction of travel of the surface-formation equipment and a plurality of inclined positions in which the longitudinal axis of the blade defines an oblique angle with the direction of travel of the surface-formation equipment.

25. The surface-formation equipment as claimed in claim 19, wherein the lower surface of the cutting edge is substantially planar and the surface-formation equipment is secured to the motorized unit at a minimal height when the lower surface of the cutting edge of the surface-formation equipment and the traction surface of the motorized unit are substantially in a same plane.

26. The motorized surface-formation equipment as claimed in claim 19, wherein the surface-formation equipment further comprises an attachment structure including at least two arms having a proximal end pivotally connected to the blade and a distal end configured to be attached to the motorized unit, the distal ends of the at least two arms are spaced-apart from one another.

* * * * *